US011281141B2

(12) United States Patent
Toratani et al.

(10) Patent No.: US 11,281,141 B2
(45) Date of Patent: Mar. 22, 2022

(54) IMAGE FORMING APPARATUS

(71) Applicant: Canon Kabushiki Kaisha, Tokyo (JP)

(72) Inventors: Yasuharu Toratani, Chiba (JP); Mitsuru Hasegawa, Ibaraki (JP); Hiroki Kawai, Chiba (JP); Ayano Ogata, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/323,365

(22) Filed: May 18, 2021

(65) Prior Publication Data

US 2021/0373471 A1 Dec. 2, 2021

(30) Foreign Application Priority Data

May 29, 2020 (JP) ..... JP2020-093913

(51) Int. Cl.
*G03G 15/20* (2006.01)

(52) U.S. Cl.
CPC ..... *G03G 15/2053* (2013.01); *G03G 15/205* (2013.01); *G03G 15/2064* (2013.01); *G03G 2215/2032* (2013.01)

(58) Field of Classification Search
CPC ..... G03G 15/205; G03G 15/2053; G03G 15/2064; G03G 2215/2032
See application file for complete search history.

(56) References Cited

U.S. PATENT DOCUMENTS

2004/0197112 A1* 10/2004 Saito ..... G03G 15/2039 399/69
2009/0245841 A1* 10/2009 Segawa ..... G03G 15/2039 399/69

FOREIGN PATENT DOCUMENTS

JP 2013178488 A * 9/2013 ..... G03G 15/205
JP 2014098891 A * 5/2014 ..... G03G 15/205
JP 2014142398 A 8/2014
JP 2020112586 A * 7/2020 ..... G03G 15/2053

* cited by examiner

*Primary Examiner* — Sevan A Aydin
(74) *Attorney, Agent, or Firm* — Venable LLP

(57) ABSTRACT

An image forming apparatus includes an endless rotatable belt, a rotary pressing member, a pressing member, a driving unit, a heating roller, a temperature detection member, and a control unit. The rotary pressing member is configured to form a nip portion between the rotary pressing member and the belt, the nip portion being a portion in which a toner image borne by a recording material is fixed to the recording material while the recording material is nipped and conveyed. The control unit is configured to control the driving unit such that the driving unit does not start to rotate the belt during a period of time for a preparatory operation if a temperature of the heating roller is higher than a predetermined temperature, wherein the preparatory operation is an operation performed for enabling image formation after an error or a jam is handled.

19 Claims, 17 Drawing Sheets

FIG.8

| DIFFERENCE IN TEMPERATURE IN BELT ROTATION DIRECTION | 60 | 70 | 80 | 90 |
|---|---|---|---|---|
| BUCKLING FAILURE | ○ | ○ | ○ | × |

IMAGE FORMING APPARATUS

BACKGROUND OF THE INVENTION

Field of the Invention

The present invention relates to image forming apparatuses such as copying machines, printers, facsimiles, and multifunction printers having a plurality of functions of these products.

Description of the Related Art

The image forming apparatuses include a fixing apparatus that fixes a toner image borne by a recording material, to the recording material by heating the toner image. Japanese Patent Application Publication No. 2014-142398 describes a fixing apparatus that uses a belt stretched by and wound around a plurality of stretching members. The fixing apparatus described in Japanese Patent Application Publication No. 2014-142398 includes a heating roller that serves as a stretching roller. The heating roller contains a halogen heater and heats the belt.

As described in Japanese Patent Application Publication No. 2014-142398, one portion of the belt in the rotational direction is locally heated by the heating roller. In this configuration, however, a temperature difference may be produced between a heated area and an unheated area of the belt. For example, if an emergency stop of the fixing apparatus is caused by an error such as a sheet jam, the belt is stopped from rotating and being heated. In this case, the difference in temperature is easily produced between an area of the belt that is in contact with the heating roller, and an area of the belt that is not in contact with the heating roller. In particular, the difference in temperature is significantly produced when images are formed, because the heating roller is kept at a high temperature.

If the difference in temperature is produced in the rotational direction of the belt, a difference in thermal expansion is locally produced between the high-temperature area and the low-temperature area of the belt. The difference in thermal expansion causes strain of the belt. If the strain is caused and the rotation of the belt is started after the error is eliminated, strong tension will be applied to a portion of the belt in which the strain has been produced. As a result, the belt may be plastically deformed and deteriorate.

An object of the present invention is to provide a configuration that suppresses the deterioration of the belt caused when the rotation of the belt is restarted after the belt is stopped due to an error in a state where the heating roller, which stretches the belt, has a high temperature.

SUMMARY OF THE INVENTION

According to a first aspect of the present invention, an image forming apparatus included an endless rotatable belt, a rotary pressing member configured to form a nip portion between the rotary pressing member and the belt, the nip portion being a portion in which a toner image borne by a recording material is fixed to the recording material while the recording material is nipped and conveyed, a pressing member configured to stretch the belt and press the rotary pressing member via the belt, a driving unit configured to rotate the belt, a heating roller comprising a heater and configured to stretch and heat the belt, a temperature detection member configured to detect a temperature of the heating roller, and a control unit configured to control the driving unit such that the driving unit does not start to rotate the belt in a period of time for a preparatory operation if the temperature of the heating roller is higher than a predetermined temperature, wherein the preparatory operation is performed for enabling image formation after an error or a jam is handled.

According to a second aspect of the present invention, an image forming apparatus includes an endless rotatable belt, a rotary pressing member configured to form a nip portion between the rotary pressing member and the belt, the nip portion being a portion in which a toner image borne by a recording material is fixed to the recording material while the recording material is nipped and conveyed, a pressing member configured to stretch the belt and press the rotary pressing member via the belt, a driving unit configured to rotate the belt, a heating roller comprising a heater and configured to stretch and heat the belt, a temperature detection member configured to detect a temperature of the heating roller, and a control unit configured to control the driving unit such that the driving unit waits to rotate the belt in a period of time for a preparatory operation if the temperature of the heating roller is higher than a predetermined temperature when the control unit receives a signal to start to rotate the belt, wherein the preparatory operation is performed for enabling image formation after an error or a jam is handled.

According to a third aspect of the present invention, an image forming apparatus includes an endless rotatable belt, a rotary pressing member configured to form a nip portion between the rotary pressing member and the belt, the nip portion being a portion in which a toner image borne by a recording material is fixed to the recording material while the recording material is nipped and conveyed, a pressing member configured to stretch the belt and press the rotary pressing member via the belt, a driving unit configured to rotate the belt, a heating roller comprising a heater and configured to stretch and heat the belt, a first temperature-detection member configured to detect a temperature of the heating roller, a second temperature-detection member configured to detect a temperature of the belt, and a control unit configured to control the driving unit such that the driving unit does not start to rotate the belt in a period of time for a preparatory operation if a temperature difference between the temperature detected by the first temperature-detection member and the temperature detected by the second temperature-detection member is larger than a predetermined temperature difference, wherein the preparatory operation is performed for enabling image formation after an error or a jam is handled.

Further features of the present invention will become apparent from the following description of exemplary embodiments with reference to the attached drawings.

BRIEF DESCRIPTION OF THE DRAWINGS

FIG. 8 is a table illustrating a relationship between the difference in temperature of the fixing belt in the rotational direction, and the buckling failure of the fixing belt.

DESCRIPTION OF THE EMBODIMENTS

First Embodiment

Figure 1:
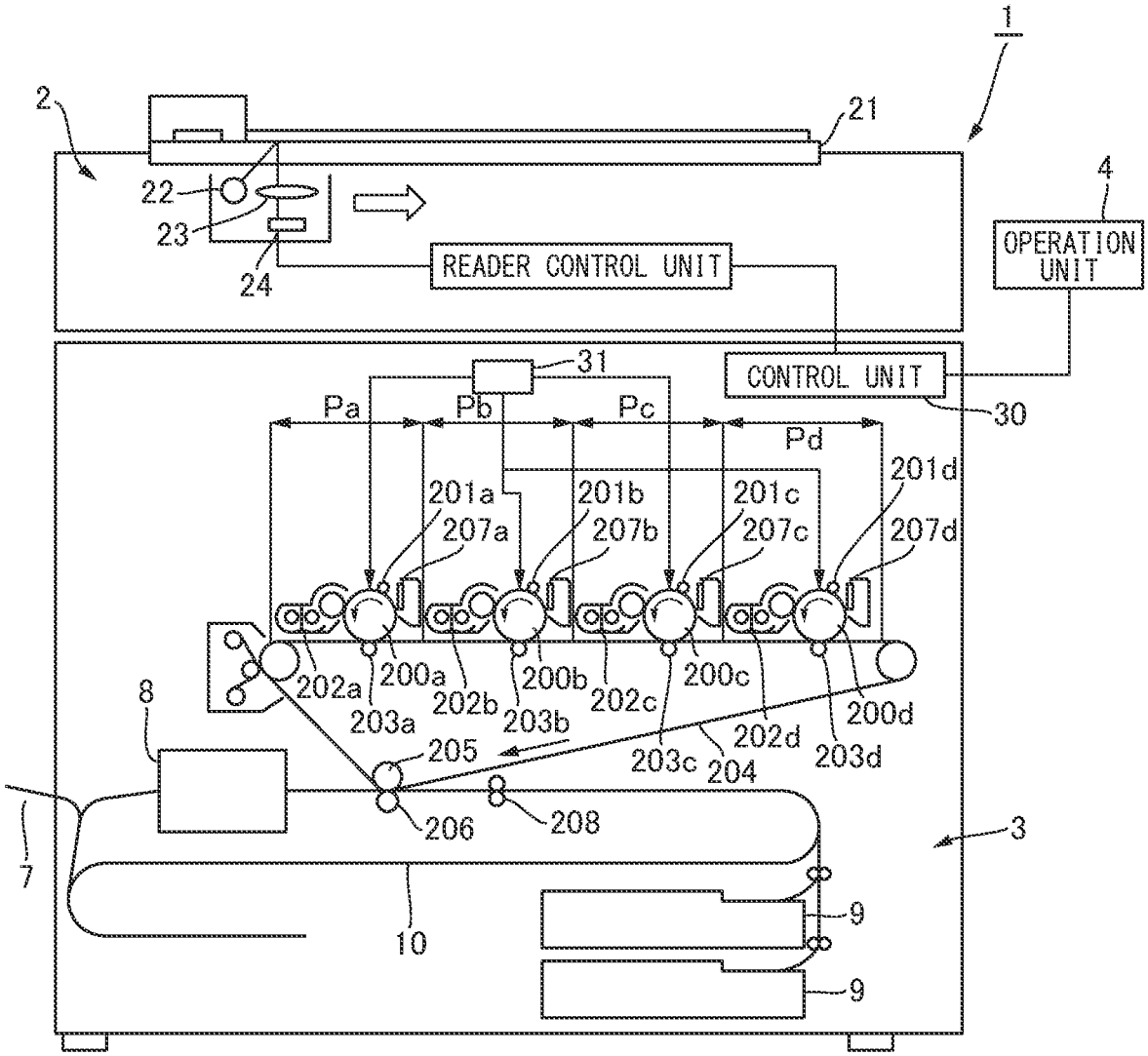
FIG. 1 is a cross-sectional view of a schematic configuration of an image forming apparatus of a first embodiment.

Next, a first embodiment will be described with reference to FIGS. 1 to 9. First, a schematic configuration of an image forming apparatus of the present embodiment will be described with reference to FIG. 1.

Image Forming Apparatus

An image forming apparatus 1 is an electrophotographic full-color printer that includes four image forming portions Pa, Pb, Pc, and Pd, which correspond to four colors of yellow, magenta, cyan, and black. In the present embodiment, the image forming apparatus 1 is a tandem-type image terming apparatus in which the image forming portions Pa, Pb, Pc, and Pd are disposed along a rotational direction of a later-described intermediate transfer belt 204. The image forming apparatus 1 forms a toner image (image) on a recording material in accordance with an image signal sent from an image reading unit (document reading apparatus) 2 connected to an image forming apparatus body 3, or from a host device, such as a personal computer, communicatively connected with the image forming apparatus body 3. The recording material may be a sheet material, such as a paper sheet, a plastic film, or a cloth sheet.

The image forming apparatus 1 includes the image reading unit 2 and the image forming apparatus body 3. The image reading unit 2 reads a document placed on a document platen glass 21. Light emitted from a light source 22 is reflected from the document, and forms an image on a CCD sensor 24 via an optical member 23 such as a lens. Such an optical unit scans the document in a direction indicated by an arrow, and transforms the image of the document into electrical-signal data rows for each line. The image signal obtained by the CCD sensor 24 is sent to the image forming apparatus body 3; and processed, as described later, by a control unit 30 for each image forming portion. Note that the control unit 30 also receives an image signal from an external host device, such as a print server.

The image forming apparatus body 3 includes the plurality of image forming portions Pa, Pb, Pc, and Pd, each of which forms an image in accordance with the above-described image signal. Specifically, the image signal is converted to a PWM (pulse width modulated) laser beam by the control unit 30. A polygon scanner 31 serves as an exposure apparatus, and performs scanning by using the laser beam in accordance with the image signal, Photosensitive drums 200*a* to 200*d* respectively serve as image bearing members of the image forming portions Pa to Pd, and are irradiated with the laser beam.

Note that the image forming portions Pa, Pb, Pc, and Pd respectively form images of yellow (Y), magenta (M), cyan (C), and black (Bk). Since the image forming portions Pa to Pd have an identical configuration, the following description will be made in detail for the image forming portion Pa of yellow Y and the description for the other image forming portions will be omitted. As described later, in the image forming portion Pa, a toner image is fort ed on the surface of the photosensitive drum 200*a* in accordance with an image signal.

A charging roller 201*a* serves as a primary charger, and charges the surface of the photosensitive drum 200*a* at a predetermined potential for the formation of an electrostatic latent image. The electrostatic latent image is formed on the surface of the photosensitive drum 200*a* which has been charged at a predetermined potential, by the laser beam from the polygon scanner 31. A development unit 202*a* develops the electrostatic latent image formed on the photosensitive drum 200*a*, and forms a toner image. A primary transfer roller 203*a* transfers the toner image formed on the photosensitive drum 200*a* onto the intermediate transfer belt 204 by discharging electricity from a back side of the intermediate transfer belt 204 and applying a primary transfer bias to the intermediate transfer belt 204. The polarity of the primary transfer bias is opposite to the polarity of the toner. After the toner image is transferred onto the intermediate transfer belt 204, the surface of the photosensitive drum 200*a* is cleaned by a cleaner 207*a*.

One toner image formed on the intermediate transfer belt 204 is conveyed to the next image forming portion, and another toner image formed by the next image forming portion and having a corresponding color is transferred onto the one toner image formed on the intermediate transfer belt 204. In this manner, toner images having respective colors are formed on the intermediate transfer belt 204 sequentially in the order of Y, M, C, and Bk, into a four-color toner image. The toner image that has passed through the image forming portion Pd, which is corresponding to a color of Bk and is located most downstream in the rotational direction of the intermediate transfer belt 204, is conveyed to a secondary transfer portion formed by a secondary-transfer roller pair 205, 206 in the secondary transfer portion, a secondary-transfer electric field, whose polarity is opposite to the polarity of the toner image formed on the intermediate transfer belt 204, is applied to a recording material, and the toner image is secondary-transferred onto the recording material.

The recording material is stored in a cassette 9. The recording material is fed from the cassette 9, conveyed to a registration portion 208 formed by a pair of registration rollers, and waits at the registration portion 208. Then, the timing is controlled for aligning the position of the toner image formed on the intermediate transfer belt 204 with the position of the recording material, and the recording material is conveyed to the secondary transfer portion at the timing by the registration portion 208.

In the secondary transfer portion, the toner image is transferred onto the recording material. The recording material is then conveyed to a fixing apparatus 8. In the fixing apparatus 8, the recording material is heated and pressed, and the toner image borne by the recording material is fixed to the recording material. The recording material having passed through the fixing apparatus 8 is discharged to a discharging tray 7. In a case where images are formed on both sides of the recording material, after a toner image is transferred and fixed to a first side (front side) of the recording material, the recording material is conveyed to a reverse-and-conveyance portion 10, and reversed. Then, another toner image is transferred and fixed to a second side (back side) of the recording material, and the recording material is discharged to the discharging tray 7 and stacked on the same.

Fixing Apparatus

Figure 2:
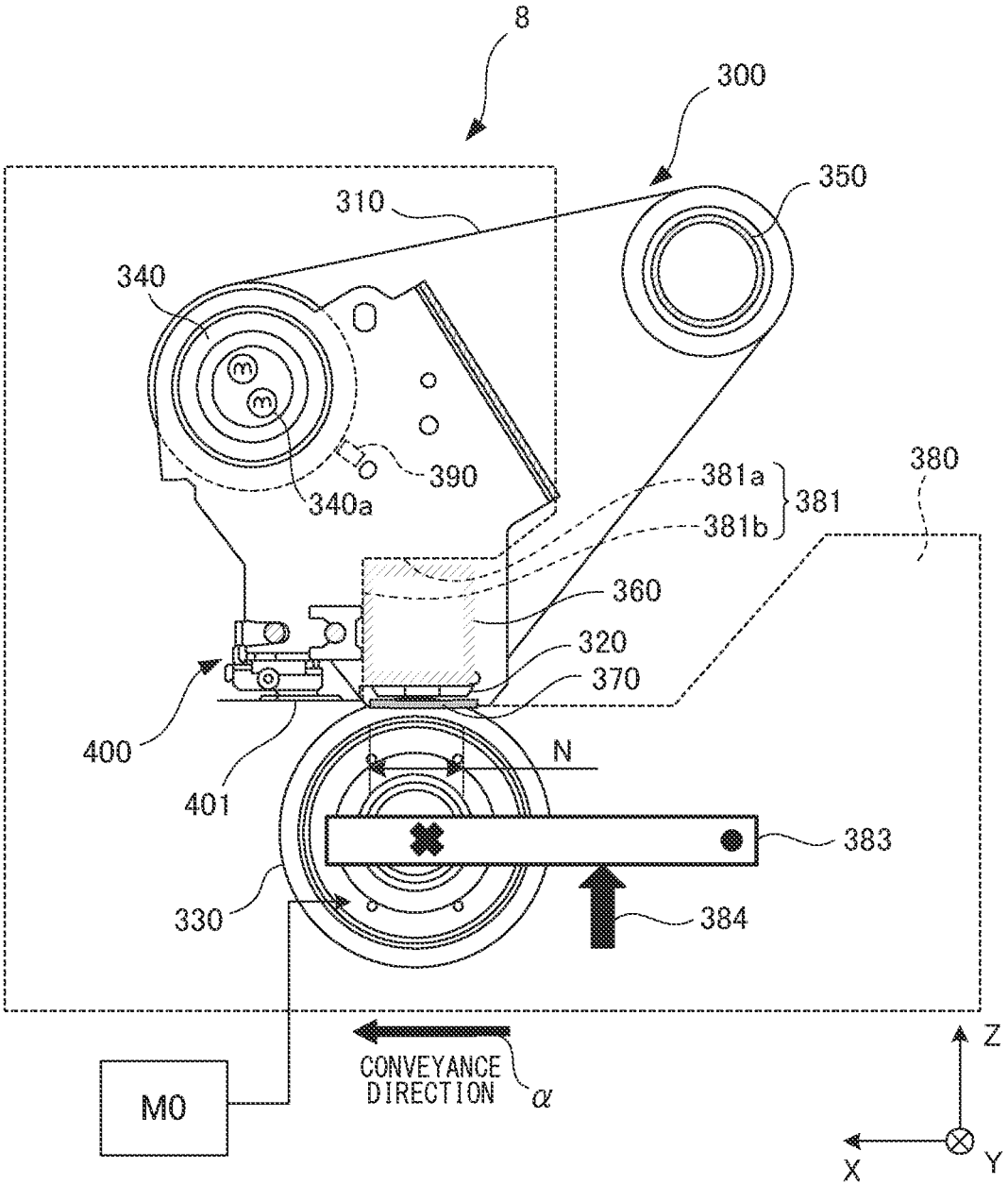
FIG. 2 is a cross-sectional view of a schematic configuration of a fixing apparatus of the first embodiment.

Next, a configuration of the fixing apparatus 8 of the present embodiment will be described with reference to FIG. 2. In the present embodiment, the fixing apparatus 8 is a belt-heating fixing apparatus that uses an endless belt. In FIG. 2, the recording material is conveyed from right to left, as indicated by an arrow α. The fixing apparatus 8 includes a heating unit 300 and a pressing roller 330. The heating unit 300 includes an endless fixing belt 310 that can rotate. The pressing roller 330 serves as a rotary pressing member, and abuts against the fixing, belt 310. Thus, the pressing roller 330 and the fixing belt 310 form a nip portion N.

The heating unit 300 includes the above-described fixing belt 310, a fixing pad 320, a heating roller 340, and a steering roller 350. The fixing pad 320 serves as a nip-portion forming member and a pad member, and the heating roller 340 and the steering roller 350 serve as stretching rollers. The pressing roller 330 serves as a driving roller that rotates in contact with the outer circumferential surface of the fixing belt 310, and that provides driving force to the fixing belt 310.

The endless fixing belt 310 has thermal conductivity and thermal resistance, and is formed like a hollow thin cylinder that has an inner diameter of 120 mm for example. In the present embodiment, the fixing belt 310 has a three-layer structure in which a base layer, an elastic layer, and a release layer are formed. The elastic layer is formed on the outer circumferential surface of the base layer, and the release layer is formed on the outer circumferential surface of the elastic layer. The base layer has a thickness of 60 μm, and is made of polyimide resin (PI). The elastic layer has a thickness of 300 μm, and is made of silicone rubber. The release layer has a thickness of 30 μm, and is made of PFA (tetrafluoroethylene-perfluoroalkoxy ethylene copolymer) that is a fluororesin. The fixing belt 310 is stretched by and wound around the fixing pad 320, the heating roller 340, and the steering roller 350, which are a plurality of stretching members. That is, the plurality of stretching members that stretch the fixing belt 310 include the heating roller 340, the steering roller 350, and the fixing pad 320. The heating roller 340 and the steering roller 350 are two stretching rollers, and the fixing pad is a pad member.

The fixing pad 320 is disposed inside the fixing belt 310 so as to face the pressing roller 330 via the fixing belt 310. The fixing pad 320 forms the nip portion N in which the recording material is conveyed while nipped by the fixing belt 310 and the pressing roller 330. In the present embodiment, the fixing pad 320 is a member formed like a long plate that extends in the width direction of the fixing belt 310 (longitudinal direction that intersects the rotational direction of the fixing belt 310, or rotation-axis direction of the heating roller 340). The fixing pad 320 is pressed by the pressing roller 330 via the fixing belt 310, so that the nip portion N is formed. The material of the fixing pad 320 is a liquid crystal polymer (LCP) resin.

A portion of the fixing pad 320 forms the nip portion N, and at least one portion of the portion of the fixing pad 320 is made flat. That is, one portion of the fixing pad 320 that is in contact with the inner circumferential surface of the fixing belt 310 via a later-described lubricating sheet 370 is made nearly flat, making the nip portion nearly flat. With this configuration, especially when a toner image is fixed to an envelope that is a recording material, creases and shift in image position can be suppressed from occurring in the envelope.

The fixing pad 320 is supported by a stay 360, which serves as a supporting member disposed inside the fixing belt 310. That is, the stay 360 is disposed opposite to the pressing roller 330 with respect to the fixing pad 320, and supports the fixing pad 320. The stay 360 is a long rigid reinforcing member that extends along the longitudinal direction of the fixing belt 310, and abuts against the fixing pad 320 and backs up the fixing pad 320. That is, when the fixing pad 320 is pressed by the pressing roller 330, the stay 360 causes the fixing pad 320 to have strength, and ensures the pressure of the pressing roller 330 applied in the nip portion N.

The stay 360 is made of metal such as stainless steel, and the cross section (transverse cross section) of the stay 360 is almost rectangular. The cross section is orthogonal to the longitudinal direction of the stay 360, which crosses the rotational direction of the fixing belt 310. For ensuring the strength of the stay 360, a material made of SUS304 (stainless steel), having a thickness of 3 mm, and used in drawing process may be used, and the stay 360 may be formed hollow so as to have an almost hollow-square-shape transverse cross section. Note that the stay 360 may be formed by combining a plurality of metal plates and fixing them to each other through welding or the like such that the cross section becomes almost rectangular. In addition, the material of the stay 360 may not be stainless steel as long as the strength of the stay 360 is ensured.

Figure 3:
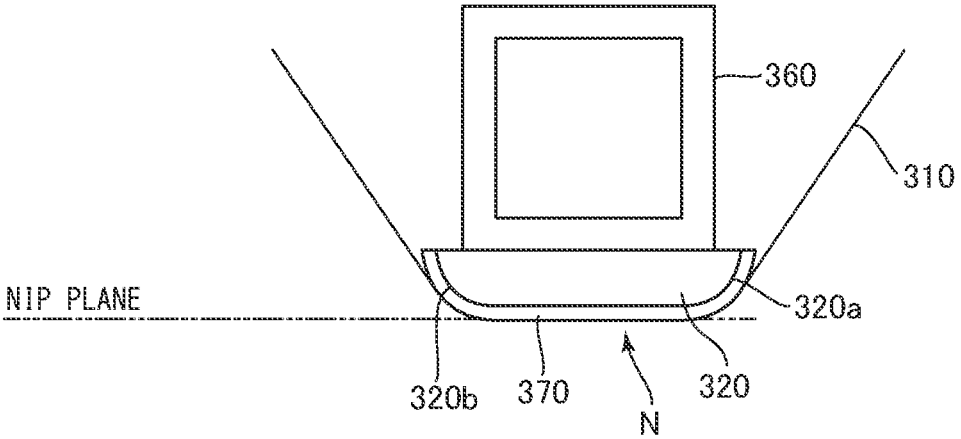
FIG. 3 is a schematic diagram illustrating a relationship between a fixing pad and a fixing belt.

In addition, as illustrated in FIG. 3, both edge portions of the fixing pad 320 located in the nip portion N in the recording-material conveyance direction are curved shape portions **320*a* and 320*b*. The curved shape portion 320*a* is curved in a direction (upward direction in FIG. 3) extending away from a nip plane toward one edge portion, and the curved shape portion 320*b* is curved in a direction (upward direction in FIG. 3) extending away from the nip plane toward the other edge portion. The nip plane is formed between the fixing belt 310 and the pressing roller 330, along a surface of the fixing pad 320 on the pressing roller 330 side (i.e., lower surface of the fixing pad 320 in FIG. 3**).

Thus, in the present embodiment, the curved shape portion **320*b*** is a downstream edge portion of the fixing pad 320, and the fixing belt 310 is curved in accordance with a curvature of the curved shape portion 320*b*. In addition, the recording material that has passed through the nip portion N is separated from the fixing belt 310 by the curvature of the fixing belt 310.

The lubricating sheet 370 is interposed between the fixing pad 320 and the fixing belt 310. In the present embodiment, the lubricating sheet 370 is a PI (polyimide) sheet made of resin and coated with PTFE (polytetrafluoroethylene). The thickness of the lubricating sheet 370 is 100 μm. On the PI sheet, projections having a height of 100 μm are formed at intervals of 1 mm for reducing the contact area between the lubricating sheet 370 and the fixing belt 310 to reduce the slide resistance.

In addition, lubricant is applied onto the inner circumferential surface of the fixing belt 310 for allowing the fixing belt 310 to smoothly slide with respect to the fixing pad 320 covered by the lubricating sheet 370. The lubricant used is silicone oil having a viscosity of 100 cSt.

As illustrated in FIG. 2, the heating roller 340 is a predetermined stretching member of the plurality of stretching members, and is disposed inside the fixing belt 310; and the fixing belt 310 is stretched by and wound around the heating roller 340, the fixing pad 320, and the steering roller 350. Since the inner circumferential surface of the fixing belt 310 is applied with the lubricant as described above, the heating roller 340 stretches the fixing belt 310 via the lubricant. The heating roller 340 is disposed downstream of the fixing pad 320 and upstream of the steering roller 350 in the rotational direction of the fixing belt 310. Note that the heating roller 340 has a function of a driving roller, which is driven by a driving unit including a motor M0 and thereby provides driving force to the fixing belt 310.

The heating roller 340 is made of metal such as aluminum or stainless steel, and formed like a cylinder. Inside the heating roller 340, a halogen heater 340*a* is disposed, as a heating unit, for heating the fixing belt 310. That is, the halogen heater 340*a* is disposed in the heating roller (stretching roller) 340. The heating roller 340 is heated up to a predetermined temperature by the halogen heater 340*a*. Thus, the heating roller 340 is a roller that heats the fixing belt 310. In other words, the halogen heater 340*a* heats the heating roller 340, and thereby heats the fixing belt 310.

In the present embodiment, the heating roller 340 is a stainless-steel pipe having an outer diameter of 40 mm and a thickness of 1 mm for example, in consideration of thermal conductivity. The halogen heater 340*a* may be one in number, but a plurality of halogen heaters is preferably used for controlling the temperature distribution of the heating roller 340 in the longitudinal direction (rotation-axis direction) of the heating roller 340. The plurality of halogen heaters 340*a* have light distributions different from each other in the longitudinal direction, and the ratio in Which each halogen heater is kept on is controlled in accordance with a size of the recording material. In the present embodiment, two halogen heaters 340*a* are disposed in the heating roller 340. Note that the heating source may not be the halogen heater, and may be another heater, such as a carbon heater, that can heat the heating roller 340.

The fixing belt 310 is heated by the heating roller 340 heated by the halogen heaters 340*a*; and is controlled, depending on the temperature detected by a thermistor 390 that serves as a temperature detection member, so as to have a predetermined target, temperature in accordance with a type of the recording material. As illustrated in FIG. 2, the thermistor 390 is disposed in contact with, or in the vicinity of the outer circumferential surface of the heating roller 340 for detecting the temperature of the heating roller 340.

The steering roller 350 is disposed inside the fixing belt 310, and the fixing belt 310 is stretched by and wound around the heating roller 340, the fixing pad 320, and the steering roller 350. Thus, the steering roller 350 is rotated by the rotation of the fixing belt 310. The steering roller 350 slants with respect to the rotation-axis direction (longitudinal direction) of the heating roller 340, and thereby controls the position (deviation position) of the fixing belt 310 in the rotation-axis direction. Specifically, the steering roller 350 has a pivot center positioned at the center of the steering roller 350 in the rotation-axis direction (longitudinal direction), and swings on the pivot center. In this manner, the steering roller 410 slants with respect to the longitudinal direction of the heating roller 340. Thus, the steering roller 410 produces difference in tension between one end portion and the other end portion of the fixing belt 310 in the longitudinal direction of the fixing belt 310, and thereby moves the fixing belt 310 in the longitudinal direction of the fixing belt 310.

The fixing belt 310, while rotating, deviates toward one of its end portions, depending on the accuracy of outer diameter of the rollers that stretch the fixing belt 310 and on the accuracy of alignment between the rollers. For this reason, such deviation is controlled by the steering roller 350. Note that the steering roller 350 may be swung by a driving source such as a motor, or by self-aligning. In addition, the pivot center may be positioned at the center of the steering roller 350 in the longitudinal direction as in the present embodiment, or may be positioned at an end portion of the steering roller 350 in the longitudinal direction.

In addition, in the present embodiment, the steering roller 350 serves also as a tension roller that is urged by a spring, which is supported by a frame of the heating unit 300, and that provides predetermined tension to the fixing belt 310. Since the tension is provided to the fixing belt 310 by the steering roller 350 in this manner, the fixing belt 310 moves along the curved shape portions 320*a* and 320*b* of the fixing pad 320. That is, the fixing belt 310 is curved along the curved shape portions 320*a* and 320*b*.

The steering roller 350 is made of metal such as aluminum or stainless steel, and formed like a cylinder. In the present embodiment, the steering roller 350 is a pipe made of stainless steel or aluminum and having an outer diameter of 40 mm and a thickness of 1 mm. End portion of the steering roller 350 are rotatably supported by bearings (not illustrated). Note that another stretching roller having no steering function may be disposed at the position of the steering roller 350, instead of the steering roller 350.

The pressing roller 330 serves as a rotary member and a driving roller, and the above-described nip portion is formed between the pressing roller and the fixing belt 310. In the nip portion, a toner image borne by the recording material is fixed to the recording material while the recording material is nipped and conveyed. The pressing roller 330 rotates in contact with the outer circumferential surface of the fixing belt 310, and provides driving force to the fixing belt 310. In the present embodiment, the pressing roller 330 is a roller including a shaft, an elastic layer formed on the outer circumferential surface of the shaft, and a release layer formed on the outer circumferential surface of the elastic layer. The shaft is made of stainless steel. The elastic layer has a thickness of 5 mm, and is made of silicone rubber. The release layer has a thickness of 50 μm, and is made of PFA (tetrafluoroethylene-perfluoroalkoxy ethylene copolymer) that is a fluororesin. The pressing roller 330 is rotatably supported by the fixing frame 380 of the fixing apparatus 8. In addition, the pressing roller 330 has a gear fixed to one end portion of the pressing roller 330, and is coupled with a motor M0 via the gear. Thus, the pressing roller 330 is rotated by the motor M1, which serves as a driving member.

The fixing frame 380 includes a heating-unit positioning portion 381, a pressing frame 383, and a pressing spring 384. The heating unit 300 is positioned with respect to the fixing frame 380 such that the stay 360 is inserted into the heating-unit positioning portion 381 and the stay 360 is fixed to the heating-unit positioning portion 381 via a fixing member (not illustrated). The heating-unit positioning portion 381 includes a pressing-direction regulation surface 381*a* that faces the pressing roller 330, and a conveyance-direction regulation surface 381*b* that is an abutment surface that the heating unit 300 abuts against in the insertion direction of the heating unit 300. The stay 360 is fixed to the heating-unit positioning portion 381 in a state where the stay 360 is prevented from moving by the pressing-direction regulation surface 381*a* and the conveyance-direction regulation surface 381*b*. When the heating unit 300 is positioned with respect to the heating-unit positioning portion 381, the pressing roller 330 is located, separated from the fixing belt 310.

After the heating unit 300 is positioned with respect to the heating-unit positioning portion 381, the pressing frame 383 is moved by a driving source and a cam (both not illustrated), so that the pressing roller 330 abuts against the fixing belt 310. Then the pressing roller 330 is pressed against the fixing pad 320 via the fixing belt 310. That is, in the present embodiment, the pressing roller 330 serves also as a pressing member that is pressed against the fixing belt 310. In the present embodiment, the force applied when an image is formed is 1000 N.

In addition, in the present embodiment, a separation apparatus 400 is disposed downstream of the nip portion N in the recording-material conveyance direction. The separation apparatus 400 includes a separation member 401 (i.e., separation plate in the present embodiment) that separates a recording material from the fixing belt 310. The separation member 401 is disposed such that a clearance is formed between the separation member 401 and the outer circumferential surface of the fixing belt 310; and separates a recording material that has passed through the nip portion N, from the fixing belt 310. Specifically, the separation member 401 is disposed closer to a portion of the outer circumferential surface of the fixing belt 310, which portion is stretched between the fixing pad 320 and the heating roller 340. The separation member 401 is formed like a blade, and the leading edge of the separation member 401 faces the outer circumferential surface of the fixing belt 310. The separation member 401 includes a metal plate, and a fluorine-based tape that is stuck on the metal plate. The fluorine-based tape is provided for preventing the toner of a recording material from adhering to the metal plate when the recording material slides on the separation member 401, and for preventing scratch from being formed on images. In the present embodiment, the stay 360 is positioned in the recording-material conveyance direction (i.e., lateral direction of the stay 360 or X direction), such that the clearance is formed between the separation member 401 and the outer circumferential surface of the fixing belt 310.

The fixing apparatus 8 configured as described above heats a toner image in the nip portion N formed between the fixing belt 310 and the pressing roller 330, while causing the fixing belt 310 and the pressing roller 330 to nip and convey a recording material that bears the toner image. With this operation, the toner image is melted and fixed to the recording material. In the present embodiment, in the image formation, the circumferential speed of the fixing belt 310 is 300 mm/s, the pressure applied in the nip portion N is 1000 N, and the temperature of the fixing belt 310 is 180° C.

Control Unit

Figure 4:
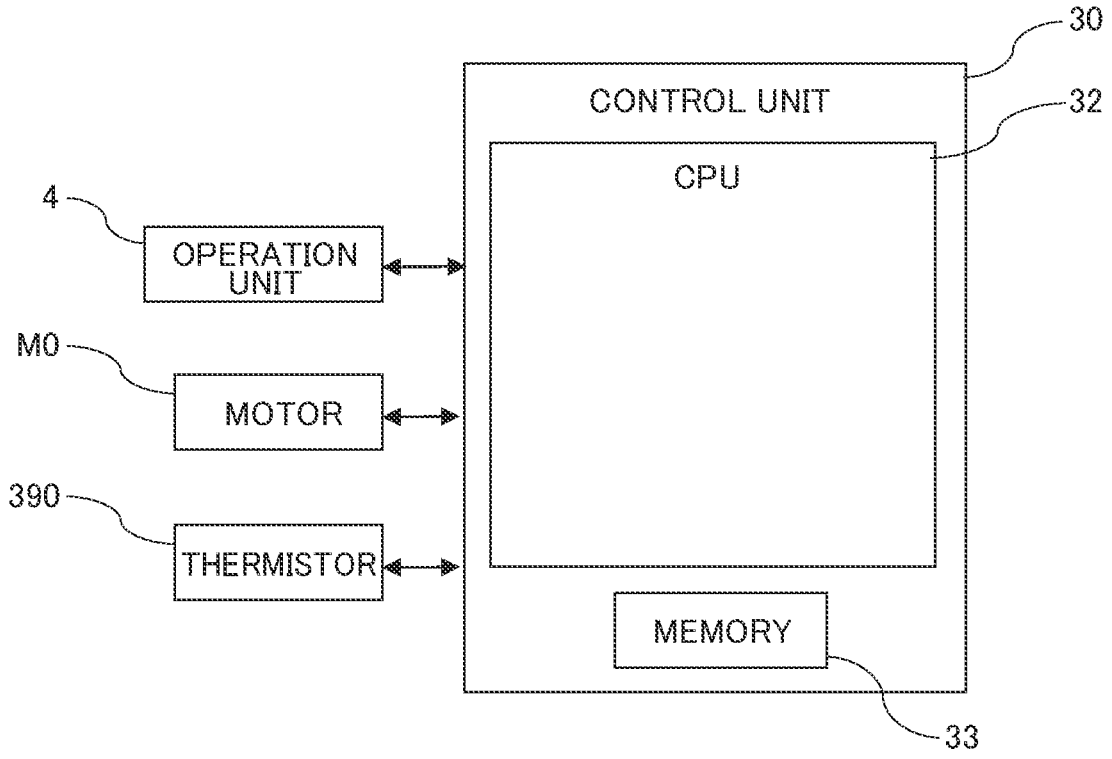
FIG. 4 is a control block diagram illustrating one portion of a control configuration of the image forming apparatus of the first embodiment.

Next, a control configuration of the control unit 30 of the image forming apparatus 1 for controlling the fixing apparatus 8 will be described with reference to FIG. 4. The control unit 30 includes a central processing unit (CPU) 32, and a memory 33 including a read only memory (ROM) and a random access memory (RAM).

The CPU 32 obtains various types of data inputted through an operation unit 4, and stores the data in the memory 33. The operation unit 4 is included in the image forming apparatus 1, and may include a touch panel and buttons. The touch panel allows a user to perform touch operation.

The image forming apparatus 1 is started when the power of the image forming apparatus 1 is turned on by a user, for example. When the image forming apparatus 1 is started, the CPU 32 reads a print (image formation) program from the memory 33 and executes the program.

The memory 33 stores various programs, such as the print program and an image forming job, and various types of data. The memory 33 may temporarily store results of computation performed in each program.

In the present embodiment, the CPU 32 controls the operation of the image forming apparatus 1 for forming an image on a recording material, by executing a print program. Note that the print program may not be a software program, and may be a microprogram executed by a digital signal processor (DSP). Thus, the CPU 32 may be shared for executing the print program and a control program such as the image forming job to perform various types of control such as the control of the image forming operation. However, the CPU 32 may use a dedicated device provided for executing the print program.

In addition, the CPU 32 controls the halogen heater 340*a*, as described above, depending on the temperature detected by the thermistor 390; and controls a motor M0 that drives the pressing roller 330. The control of the motor M0 performed depending on the temperature detected by the thermistor 390 will be described later.

Temperature Distribution of Fixing Belt in Rotational Direction

Figure 5:
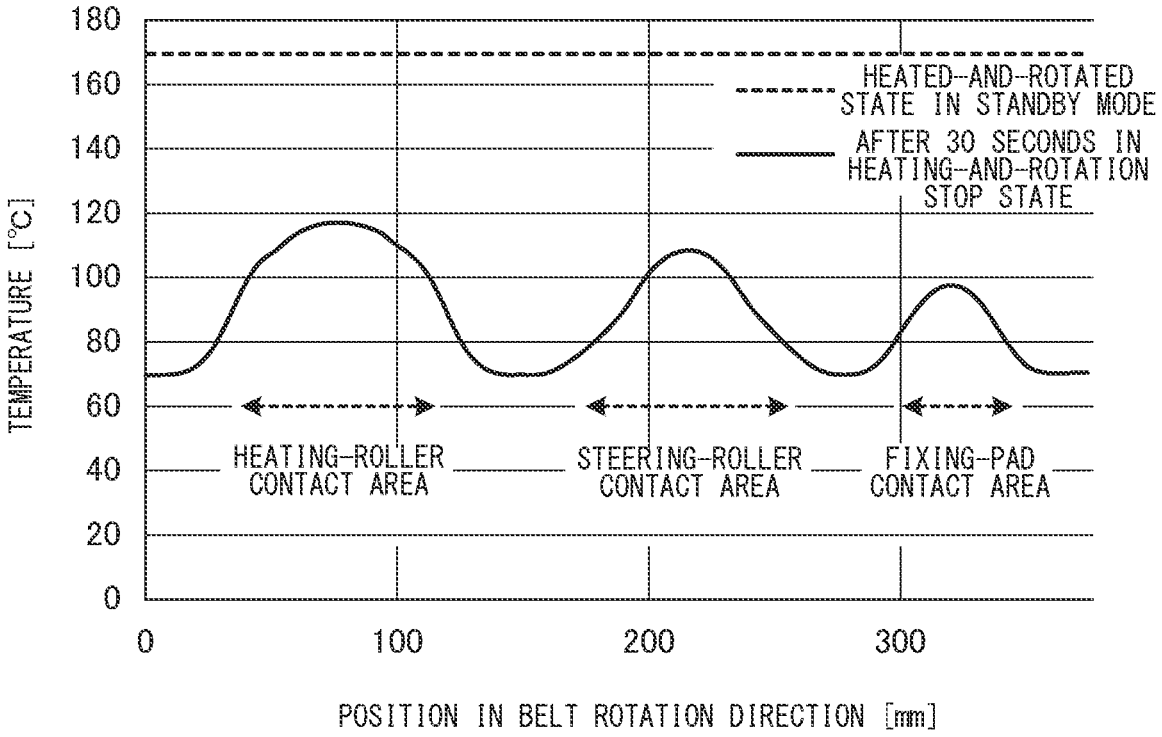
FIG. 5 is a graph illustrating a temperature distribution of the fixing belt in a rotational direction of the fixing belt.

As described above, in the configuration in which one portion of the fixing belt 310 in the rotational direction is locally heated by the heating roller 340, a temperature difference may be produced between a heated area and an unheated area of the fixing belt 310. The difference in temperature will be described with reference to FIGS. 5 to 8. FIG. 5 illustrates a temperature distribution of the fixing belt 310 in the rotational direction, obtained in a heated-and-rotated state in standby mode; and a temperature distribution of the fixing belt 310 in the rotational direction, obtained in a heating-and-rotation stop state.

The heated-and-rotated state in standby mode is a state in which the fixing belt 310 is rotated in a standby mode of the fixing apparatus 8. In the standby mode, the fixing apparatus 8 waits for an input of an image forming signal. In the present embodiment, the temperature of the heating roller 340 is lower in the standby mode than that in the image forming operation. In addition, in the standby mode, the fixing belt 310 and the pressing roller 330 are separated from each other. For example, in the standby mode, the temperature of the heating roller 340 is controlled so that the heating roller 340 has a temperature of 180° C. In the present embodiment, the heating-and-rotation stop state is a state in which 30 seconds have elapsed in the standby mode since the rotation of the fixing belt 310 and the heating by the halogen heater 340*a* were stopped. In the present embodiment, the rotational speed of the fixing belt 310 in the standby mode is lower than the rotational speed (maximum rotational speed) of the fixing belt 310 in the image forming operation. Specifically, the rotational speed of the fixing belt 310 is 50 mm/sec in the standby mode, and 300 mm/sec in the image forming operation.

The horizontal axis of FIG. 5 represents the position of the fixing belt 310 in the rotational direction. In FIG. 5, the midpoint between the heating roller 340 and the fixing pal 320 is set as zero in the horizontal axis, and the positive direction of the horizontal axis corresponds to the clockwise direction of FIG. 2. As indicated by a broken line of FIG. 5, in the heated-and-rotated state in standby mode of the fixing belt 310, the temperature is controlled so that the heating roller 340 has a temperature of 180° C. Thus, the fixing belt 310 is heated uniformly in the rotational direction, and has a temperature of about 170° C.

On the other hand, as indicated by a solid line of FIG. 5, after 30 seconds have elapsed since the heating and the rotation were stopped, the heat of the fixing belt 310 is dissipated and the temperature of the fixing belt 310 decreases because the heating is stopped. However, the temperature of portions of the fixing belt 310 that are in contact with the heating roller 340, the steering roller 350, and the fixing pad 320 decreases slowly after the heating and the rotation were stopped, because the heating roller 340, the steering roller 350, and the fixing pad 320 store heat when the fixing belt 310 is heated and rotated. In contrast, the temperature of the other portions of the fixing belt 310 that are not in contact with any of the stretching members decreases fast, because the other portions are part of the thin belt having less heat capacity.

Thus, a difference in rate of temperature decrease is produced in the rotational direction of the fixing belt 310. As a result, a difference in temperature is produced in the fixing belt 310 in the rotational direction, between a wound portion that is wound around a stretching member such as a roller and an unwound portion that is not wound around any stretching member. Consequently, a difference in thermal expansion is locally produced, causing strain of the fixing belt 310. In particular, the difference in temperature tends to be produced significantly if the heat capacity of the heating roller 340, the steering roller 350, and the fixing pad 320 is larger than the heat capacity of the fixing belt 310.

Figure 6A:
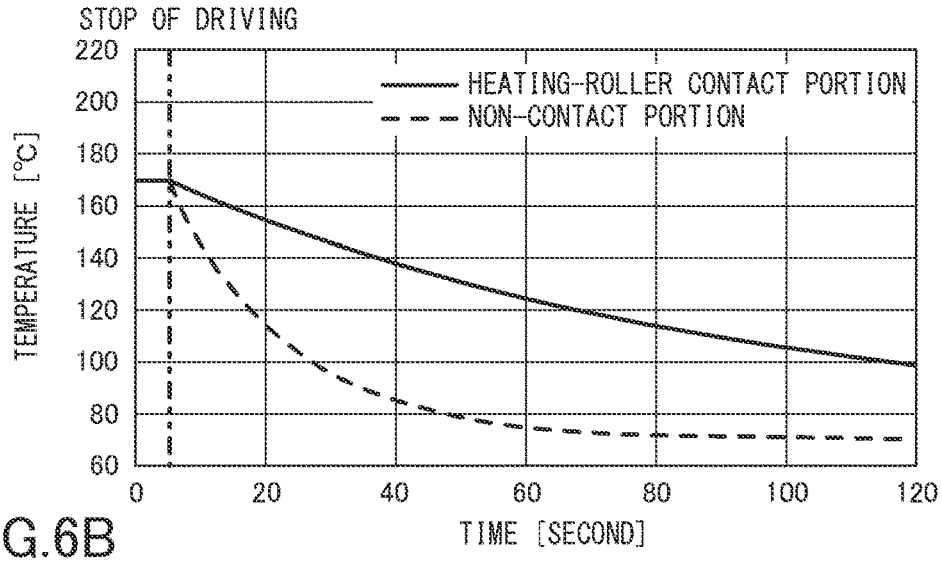
FIG. 6A is a graph illustrating the temperature of the fixing belt versus time, obtained when the fixing belt has a temperature of 170° C. when the rotation of the fixing belt is stopped.
Figure 6B:
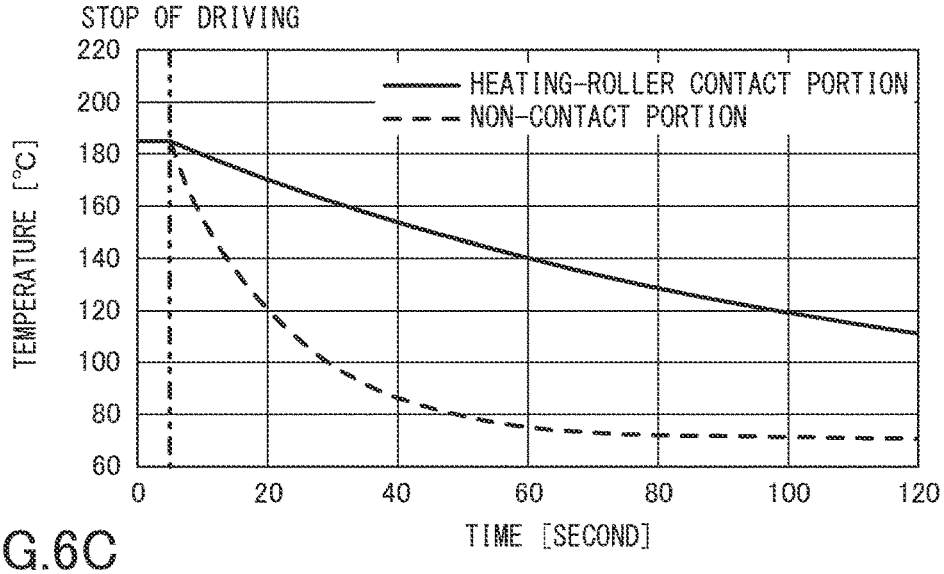
FIG. 6B is a graph illustrating the temperature of the fixing belt versus time, obtained when the fixing belt has a temperature of 185° C. when the rotation of the fixing belt is stopped.
Figure 6C:
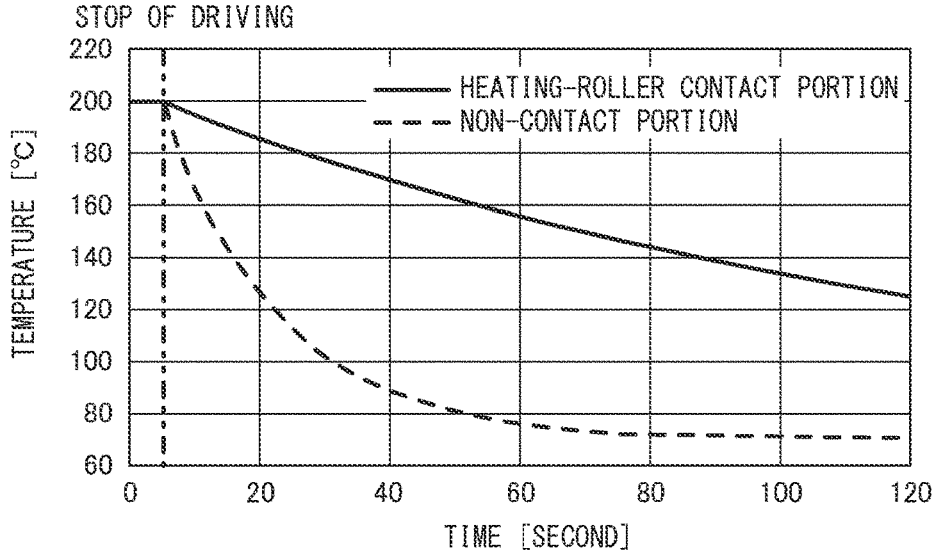
FIG. 6C is a graph illustrating the temperature of the fixing belt versus time, obtained when the fixing belt has a temperature of 200° C. when the rotation of the fixing belt is stopped.

FIGS. 6A to 6C each illustrate the temperature of the fixing belt 310 versus time, obtained after the rotation of the fixing belt 310 was stopped when the heating roller 340 had a corresponding temperature. The temperature of the fixing belt 310 obtained when the rotation of the fixing belt 310 was stopped is 170° C. in FIG. 6A, 185° C. in FIG. 6B, and 200° C. in FIG. 6C. The temperature of 170° C. is a temperature that is set for a print wait mode (standby mode). The temperature of 185° C. is a temperature that is set for a normal print mode (in this mode, the grammage is 80 gsm or 80 g/m$^2$). The temperature of 200° C. is a temperature that is set for a thick-paper-sheet print mode (in this mode, the grammage is 300 gsm or more, or 300 g/m$^2$ or more).

The horizontal axis represents the time, and the rotation of the fixing belt 310 was stopped when 5 seconds had elapsed. The temperature (indicated by a solid line) of a contact portion of the fixing belt 310, which was in contact with the heating roller 340, was obtained by measuring the temperature of a center (in the rotational direction) of the contact portion by using a non-contact radiation thermometer positioned on the outer circumferential surface side. In addition, the temperature (indicated by a broken line) of a non-contact portion of the fixing belt 310 was obtained by measuring the temperature of a midpoint of the fixing belt 310 between the heating roller 340 and the steering roller 350, by using a non-contact radiation thermometer positioned on the outer circumferential surface side.

The temperature of the contact portion of the fixing belt 310, which was in contact with the heating roller 340, decreased more slowly as the heating roller 340 had a higher temperature when the rotation of the fixing belt 310 was stopped. This is because the contact portion cools less as the heating roller 340 stores more heat. In contrast, the temperature of the non-contact portion of the fixing belt 310 was less affected by the temperature of the heating roller 340 obtained when the rotation of the fixing belt 310 was stopped, and thus decreased almost uniformly. The maximum difference in temperature of the fixing belt 310 in the rotational direction is 53° C. in FIG. 6A, 67° C. in FIG. 6B, and 82° C. in FIG. 6C. Thus, the maximum difference in temperature increases as the heating roller 340 has a higher temperature when the fixing belt 310 is stopped.

Figure 7:
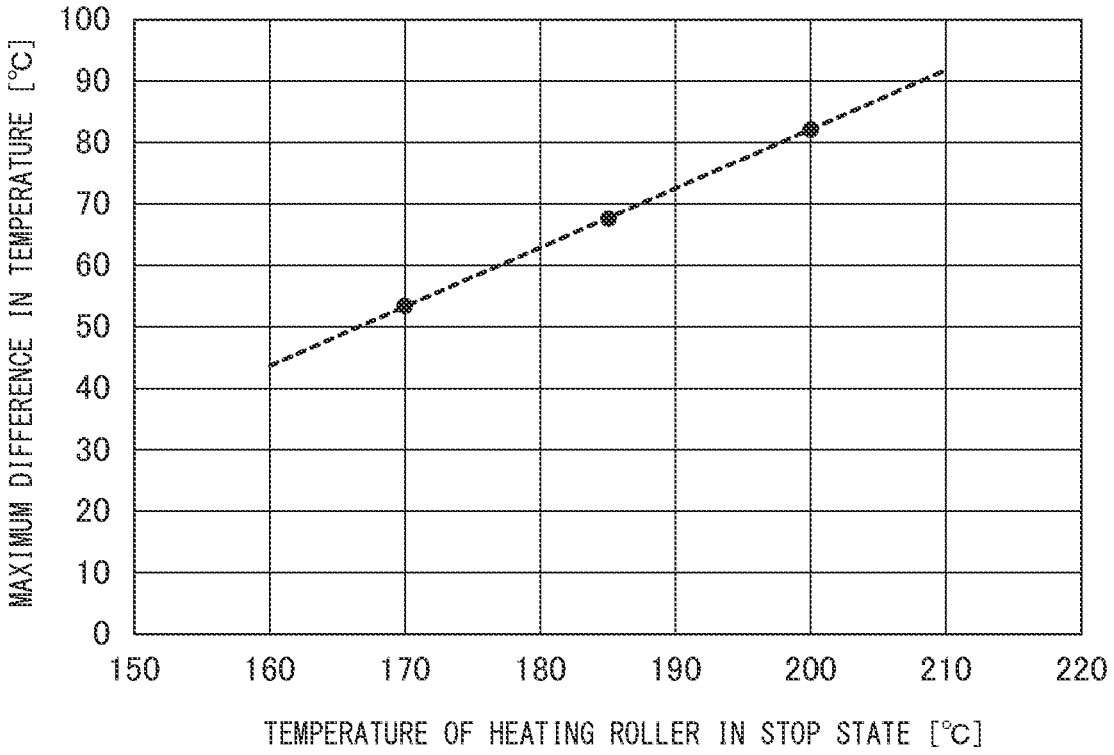
FIG. 7 is a graph illustrating a relationship between the temperature of the heating roller obtained when the rotation of the fixing belt is stopped, and the maximum difference in temperature of the fixing belt in the rotational direction.

FIG. 7 illustrates a relationship between the temperature of the heating roller 340 obtained when the rotation of the fixing belt 310 was stopped, and the maximum difference in temperature of the fixing belt 310 in the rotational direction. FIG. 8 illustrates the difference in temperature of the fixing belt 310 in the rotational direction, and experimental results on the occurrence of buckling failure of the fixing belt 310. A symbol "o" indicates that no buckling failure occurred, and a symbol "x" indicates that a buckling failure occurred. The buckling failure was determined visually. The experimental results show that the buckling failure does not occur if the difference in temperature of the fixing belt 310 is 80° C. or less in the rotational direction, but occurs if the difference in temperature of the fixing belt 310 is 90° C. in the rotational direction. In FIG. 7, for making the maximum difference in temperature of the fixing belt 310 equal to or lower than 80° C. in the rotational direction for preventing the buckling failure, it is necessary to suppress the temperature of the heating roller 340 to a value lower than 200° C., preferably equal to or lower than 185° C., when the rotation of the fixing belt 310 is stopped. In the present embodiment, in the normal operation of the fixing apparatus 8, the mode of the fixing apparatus 8 transitions from an image forming operation or a standby mode to a power-off mode or a sleep mode. Thus, in the normal operation, for preventing such a high temperature from occurring in the power-off mode or the sleep mode, the fixing belt 310 is stopped after the heater is de-energized and the fixing belt 310 is rotated for a predetermined period of time. However, if a sheet jam or an error occurs in an image forming operation, the rotation of the fixing belt 310 is stopped in emergency. In this case, the fixing belt 310 may be stopped in a state where the difference in temperature may affect the fixing belt 310.

Control of Fixing Belt of Present Embodiment Performed When Fixing Belt is Driven As described above, if an error occurs, the rotation of the fixing belt 310 is stopped in emergency in a state where the difference in temperature may affect the fixing belt 310. If the difference in temperature is produced in the rotational direction of the fixing belt 310, the strain is produced in the fixing belt 310. If the strain exceeds the yield stress of the fixing belt 310, the buckling failure may occur in the fixing belt 310. In this case, the recovery operation, performed after the sheet jam is handled or the error is eliminated, is performed in a state where the fixing belt 310 has such a large temperature difference. Thus, when the rotation of the fixing belt 310 is started, strong tension is applied to a portion of the fixing belt 310 in which the strain has been produced, possibly increasing the strain.

For this reason, in the present embodiment, when the CPU (see FIG. 4) that serves as a control unit is to start to rotate the fixing belt 310 in a recovery operation performed after an error is eliminated, the CPU 32 does not start to rotate the fixing belt 310 if the temperature detected by the thermistor 390 is higher than a predetermined temperature. In addition, in the present embodiment, the CPU 32 starts to rotate the fixing belt 310 after the temperature detected by the thermistor 390 becomes equal to or lower than the predetermined temperature. Note that the CPU 32 is to start to rotate the fixing belt 310 when receiving an instruction to start to rotate the fixing belt 310. Specifically, the CPU 32 is to start to rotate the fixing belt 310 when the start of a print operation is requested, as well as when the power of the apparatus is turned on or when the preparatory operation (recovery operation) is performed for resuming the apparatus from the sleep mode.

Next, a startup operation including a recovery operation will be described. First, a preparatory operation performed when the power is turned on will be described. Before the power is turned on, the fixing belt 310 and the pressing roller 330 are in a state where they are separated from each other. After the power is turned on and before the rotation of the fixing belt 310 is started, the CPU 32 checks the temperature of the heating roller 340. Specifically, the CPU 32 determines whether the temperature of the heating roller 340 is lower than 120° C. (first set temperature). If the temperature of the heating roller 340 is lower than 120° C., the CPU 32 performs the following preparatory operation. The CPU 32 keeps the state where the fixing belt 310 and the pressing roller 330 are separated from each other, sets a standby-mode target temperature (standby temperature) to a target temperature, energizes the heater, and repeats a rotation operation and a stop operation. In the rotation operation, the fixing belt 310 is rotated for a first period of time at a standby-mode rotational speed; and in the stop operation, the fixing belt 310 is stopped for a second period of time. If the temperature of the heating roller 340 reaches the standby temperature, the CPU 32 changes the mode of the fixing apparatus 8 to the standby mode in which the fixing belt 310 is continuously rotated at the standby-mode rotational speed. As described above, after the power is turned on and before the rotation of the fixing belt 310 is started, the CPU 32 checks the temperature of the heating roller 340. If the temperature of the heating roller 340 is equal to or higher than 120° C. and lower than 185° C. (second set temperature), the CPU 32 keeps the state where the fixing belt 310 and the pressing roller 330 are separated from each other, sets the standby-mode target temperature (standby temperature) to the target temperature, energizes the heater, and rotates the fixing belt 310 at the standby-mode rotational speed. If the temperature of the heating roller 340 reaches the standby temperature, the CPU 32 changes the mode of the fixing apparatus 8 to the standby mode in which the fixing belt 310 is continuously rotated at the standby-mode rotational speed.

After the power is turned on and when the CPU 32 receives a signal to rotate the fixing belt 310, the CPU 32 checks the temperature of the heating roller 340. If the temperature of the heating roller 340 is equal to or higher than 185° C., the CPU 32 does not rotate the fixing belt 310 (that is, the CPU 32 waits), as described later. In this case, the CPU 32 brings the fixing belt 310 that is in a stop state and the pressing roller 330 that is in a stop state, into contact with each other; and thereby forms the nip portion. Then the CPU 32 de-energizes the heater in this state. If the temperature of the heating roller 340 decreases to 185° C., the CPU 32 separates the pressing roller 330 from the fixing belt 310. Then the CPU 32 keeps the state where the fixing belt 310 and the pressing roller 330 are separated from each other, sets the standby-mode target temperature (standby temperature) to the target temperature, energizes the heater, and rotates the fixing belt 310 at the standby-mode rotational speed. If the temperature of the heating roller 340 reaches the standby temperature (image-formation start temperature, image formation temperature), the CPU 32 changes the mode of the fixing apparatus 8 to the standby mode in which the fixing belt 310 is continuously rotated at the standby-mode rotational speed. In a state where the power is on, the signal to rotate the fixing belt 310 is sent to the CPU 32 after a predetermined series of operations including the operation to check the formation of the nip portion and the operation to check the de-energization of the heater. That is, sending the signal to rotate the fixing belt 310 is included in the sequence of operations. In addition, for shortening the time taken to decrease the temperature of the heating roller 340 to 185° C., a cooling, fan that is disposed in the fixing apparatus 8 may be operated while the nip portion is formed. In addition, although the pressing roller 330 is separated from the heating roller 340 when the temperature of the heating roller 340 decreases to 185° C. as described above, the pressing roller 330 may be separated from the heating roller 340 when the temperature of the heating roller 340 decreases to 150° C. (third set temperature), which is lower than 185° C. The description has been made for the case where the above-described operations are performed when the power is turned on. In addition to this, the above-described operations are also performed when a recovery operation is performed after a sheet jam is handled, in a state where the power is on.

Figure 9:
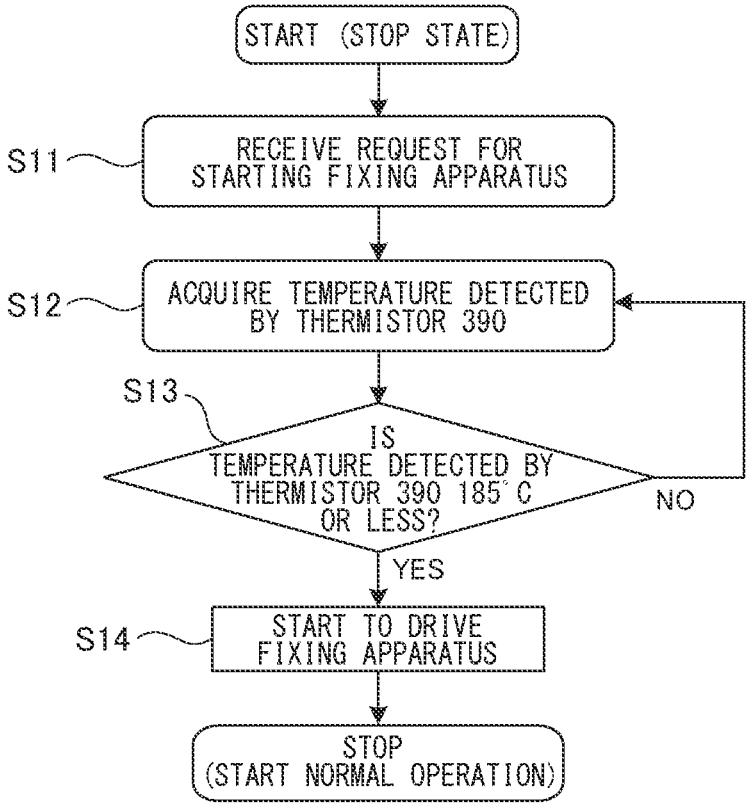
FIG. 9 is a flowchart illustrating control performed when the fixing apparatus of the first embodiment is driven.

Hereinafter, a flow of control performed when the fixing belt 310 is driven (job is started) will be described with reference to FIG. 9. The CPU 32 receives a request for starting to drive the fixing apparatus 8 that is in a stop state, that is, a request for starting to rotate the fixing belt 310 (S11). Then the CPU 32 obtains the temperature detected by the thermistor 390 (S12). As described above, receiving the request for starting to drive the fixing apparatus 8 means receiving, by the CPU 32, a signal of a request for starting a print operation, for example.

The CPU 32 then determines whether the temperature obtained in S12 is equal to or lower than a predetermined temperature (185° C. in the present embodiment) (S13). If the temperature is higher than the predetermined temperature (185° C.) (S13: NO), then the CPU 32 returns to S12, keeps the stops state of rotation of the fixing belt 310, and obtains the temperature detected by the thermistor 390 again. In the above-described operations, the CPU 32 may keep the pressing roller 330 away from the fixing belt 310, or may keep the pressing roller 330 in contact with the fixing belt 310. In a case where the CPU 32 brings the pressing roller 330 into contact with the fixing belt 310, the CPU 32 may bring the pressing roller 330 into contact with the fixing belt 310 when receiving the request for starting to drive the fixing apparatus 8.

If the temperature obtained in S12 is equal to or lower than the predetermined temperature (185° C.) (S13: YES), then the CPU 32 starts to drive the fixing apparatus 8, that is, starts to rotate the fixing belt 310 (S14). When the CPU 32 starts to drive the fixing apparatus 8, the CPU 32 sets the speed of the fixing belt 310 at a standby speed, and starts to drive the fixing belt 310. In the present embodiment, the standby speed is lower than a print speed (e.g., 300 mm/s), and is 50 mm/s for example. Although the CPU 32 starts to rotate the fixing belt 310 at the standby speed in the present embodiment, the CPU 32 may start to rotate the fixing belt 310 at the print speed. In another case, the rotational speed of the fixing belt 310 may be changed during the rotation of the fixing belt 310. Then the CPU 32 ends the control performed for starting to drive the fixing apparatus 8, and starts the control performed for the normal operation.

As described above, when the CPU 32 receives an instruction to start to rotate the fixing belt 310, the CPU 32 does not start to rotate the fixing belt 310 if the temperature detected by the thermistor 390 is higher than the predetermined temperature. In this case, the CPU 32 starts to rotate the fixing belt 310 when the temperature detected by the thermistor 390 becomes equal to or lower than the predetermined temperature. Although the predetermined temperature is 185° C. or less in the above description, the predetermined temperature may be less than 200° C. That is, the CPU 32 may not start to rotate the fixing belt 310 if the temperature detected by the thermistor 390 is equal to or higher than 200° C., and may start to rotate the fixing belt 310 if the temperature detected by the thermistor 390 is lower than 200° C.

Figure 10:
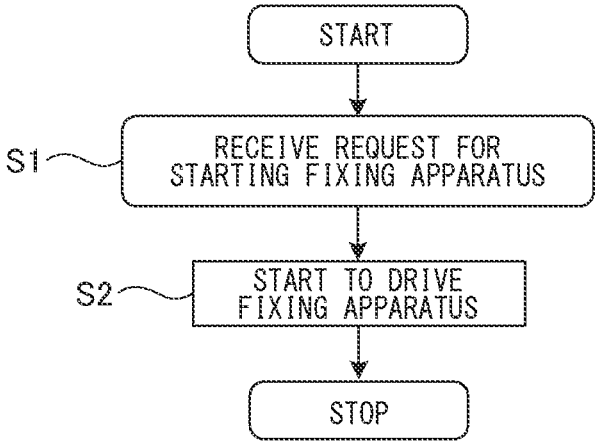
FIG. 10 is a flowchart illustrating control performed when a fixing apparatus of a comparative example is driven.

Control of Fixing Belt of Comparative Example Performed When Fixing Belt is Driven Next, control performed when a fixing belt 310 of a fixing apparatus 8 of a comparative example is driven will be described with reference to a flowchart illustrated in FIG. 10. The CPU 32 receives a request for starting to drive the fixing apparatus 8 that is in a stop state, that is, a request for starting to rotate the fixing belt 310 (S1). Then the CPU 32 starts to drive the fixing apparatus 8, that is, starts to rotate the fixing belt 310 (S2). Thus, if the CPU 32 receives a request for starting a print operation when the fixing apparatus 8 is in a stop state, the CPU 32 sets the speed of the fixing belt 310 at the standby speed, and immediately starts to drive the fixing apparatus 8.

As described above, in the present embodiment, if the temperature detected by the thermistor 390 is higher than a predetermined temperature when the fixing belt 310 is to be driven, the CPU 32 does not start to rotate the fixing belt 310. In this case, the CPU 32 starts to rotate the fixing belt 310 after the temperature detected by the thermistor 390 becomes equal to or lower than the predetermined temperature. With this operation, the thermal expansion and strain of the fixing belt 310 that are locally produced by a difference in temperature in the rotational direction can be suppressed. As a result, the buckling failure of the fixing belt 310 can be suppressed, and image defects can be prevented from being produced.

In the present embodiment, the temperature of the heating roller 340 is detected by the thermistor 390, and the above-described control is performed depending on the temperature detected by the thermistor 390. However, the thermistor 390 may detect the temperature of the outer circumferential surface of a portion of the fixing belt 310 that is wound around the heating roller 340, and the above-described control may be performed depending on the temperature detected by the thermistor 390. That is, the temperature of the portion of the fixing belt 310 that is wound around the heating roller 340, which serves as a predetermined stretching member, may be the temperature of the heating roller 340 itself, or may be the temperature of the outer circumferential surface of the portion of the fixing belt 310 that is wound around the heating roller 340. The outer circumferential surface of the portion of the fixing belt 310 that is wound around the heating roller 340 is the outer circumferential surface of the portion of the fixing belt 310 that is in contact with the heating roller 340, and the outer circumferential surface ranges from its upstream edge to downstream edge in the rotational direction of the fixing belt 310. In this case, the thermistor 390 is disposed in contact with or in the vicinity of the outer circumferential surface of the portion of the fixing belt 310.

In the present embodiment, the fixing member is a belt (a toner image that is still not fixed to a recording material contacts the fixing member). However, the pressing member, which and the fixing member form the nip portion, may be a belt; and the above-described control may be performed in this configuration. In another case, both of the fixing member and the pressing member may be belts, and the above-described control may be performed in this configuration.

Second Embodiment

Figure 11:
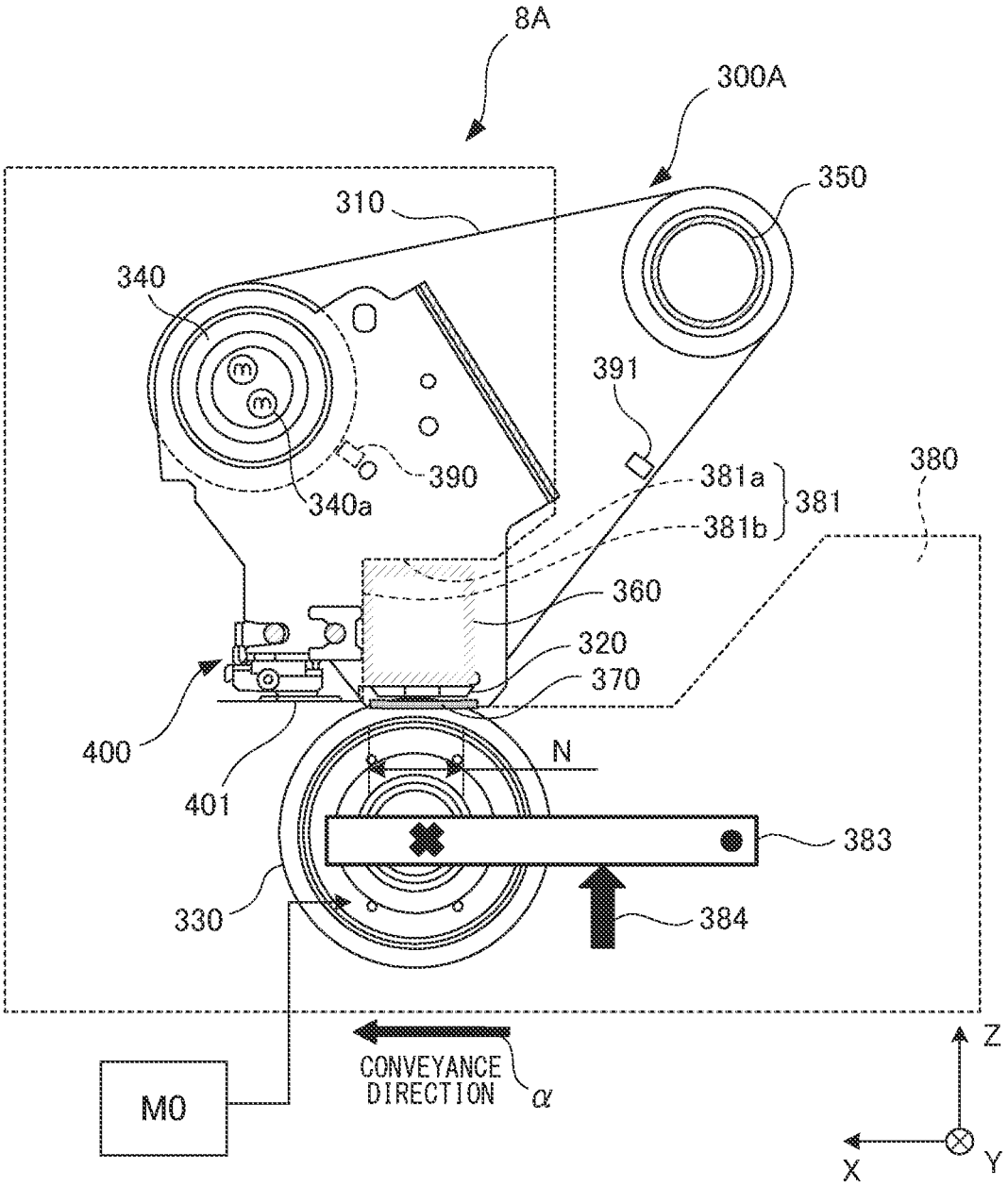
FIG. 11 is a cross-sectional view of a schematic configuration of a fixing apparatus of a second embodiment.

Next, a second embodiment will be described with reference to FIGS. 11 to 13. In the above-described first embodiment, the temperature of the heating roller 340 is detected by the thermistor 390, and the CPU 32 determines whether to start to rotate the fixing belt 310, depending on the temperature detected by the thermistor 390. In the present embodiment, however, before starting to rotate the fixing belt 310, the CPU 32 obtains the temperature of the heating roller 340 detected by the thermistor 390, and the temperature of a portion of the fixing belt 310 that is not wound around any stretching member. The latter temperature is detected by a thermistor 391. Then the CPU 32 determines whether to start to rotate the fixing belt 310, depending on the difference between the temperature detected by the thermistor 309 and the temperature detected by the thermistor 391. Since the other configuration and operation are the same as those of the above-described first embodiment, a component identical to a component of the first embodiment is given an identical symbol, duplicated description and illustration will be omitted or simplified, and features different from the first embodiment mill be mainly described below.

In the first embodiment, the CPU 32 determines whether to start to rotate the fixing belt 310, depending on the temperature detected by the thermistor 390 disposed at the heating roller 340. However, the difference in temperature of the fixing belt 310 in the rotational direction may change with time in a stop state. Thus, there may be a timing at which the CPU 32 can start to drive the fixing belt 310 in the stop state.

Referring to the above-described FIG. 6C, the difference in temperature of the fixing belt 310 in the rotational direction exceeds 80° C. when 35 seconds have elapsed since the stop of the rotation. Thus, if the CPU 32 receives a next print signal within 30 seconds and drives the fixing belt 310, the difference in temperature of the fixing belt 310 in the rotational direction will not exceed 80° C. As described with reference to FIG. 8, the buckling failure may occur if the difference in temperature of the fixing belt 310 in the rotational direction exceeds 80° C. For this reason, if the difference in temperature of the fixing belt 310 in the rotational direction exceeds 80° C., it is preferable to prevent the difference in temperature from increasing any more, by keeping stopping the fixing belt 310. Thus, in the present embodiment, the fixing belt 310 is controlled and driven in the following configuration.

A fixing apparatus 8A of a heating unit 300A of the present embodiment includes two thermistors 390 and 391. The thermistor 390 serves as a first temperature-detection member, and detects the temperature of the heating roller 340, which serves as a predetermined stretching member. The thermistor 391 serves as a second temperature-detection member, and detects the temperature of a portion of the fixing belt 310 that is not in contact with the heating roller 340, the steering roller 350, and the fixing pad 320, which are a plurality of stretching members.

Specifically, the thermistor 391 is disposed between the steering roller 350 and the fixing pad 320 in the rotational direction of the fixing belt 310. In addition, the thermistor 391 is disposed inside the inner circumferential surface of a portion of the fixing belt 310 that is not wound around any of the plurality of stretching members. The thermistor 391 is disposed in contact with or in the vicinity of the unwound portion of the fixing belt 310. In the present embodiment, since the thermistor 391 is disposed at the unwound portion of the fixing belt 310 as described above, the CPU 32 detects the difference in temperature of the fixing belt 310 in the rotational direction, before the fixing belt 310 is driven. If the difference in temperature exceeds a predetermined temperature, the CPU 32 does not start to drive the fixing belt 310. For example, the predetermined difference in temperature is 80° C.

Figure 12:
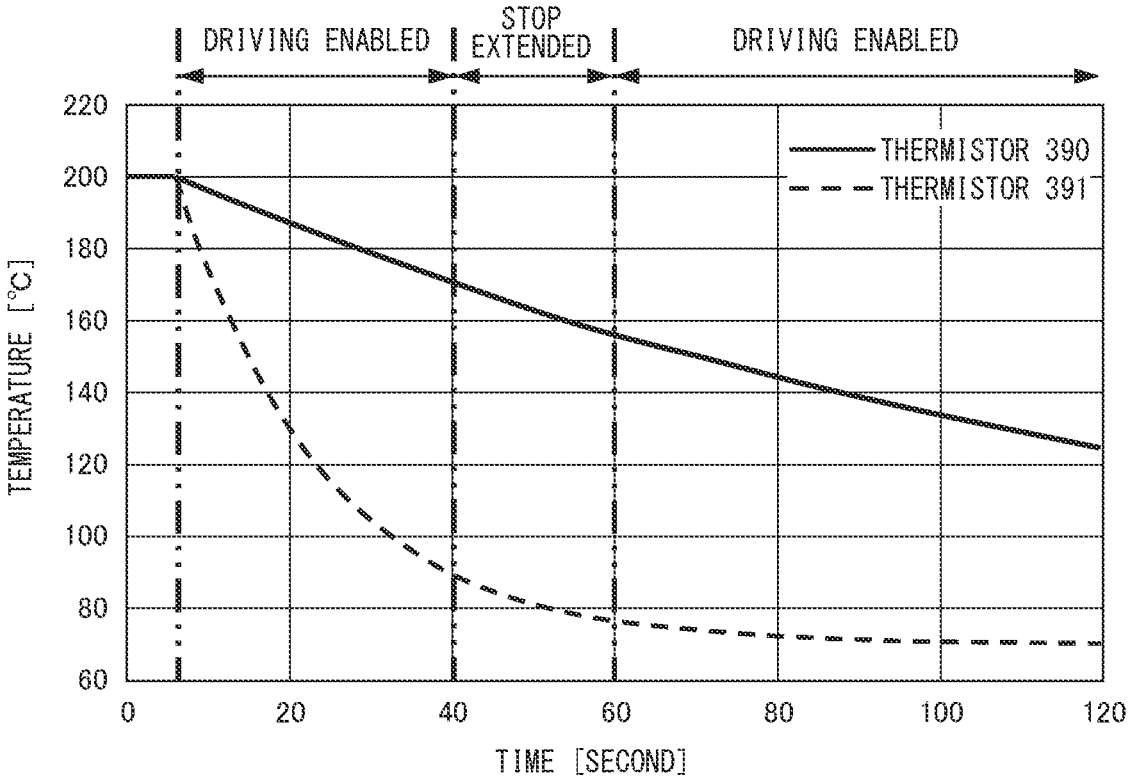
FIG. 12 is a graph illustrating the difference in temperature between two thermistors versus time, obtained when the fixing apparatus of the second embodiment is driven.
Figure 13:
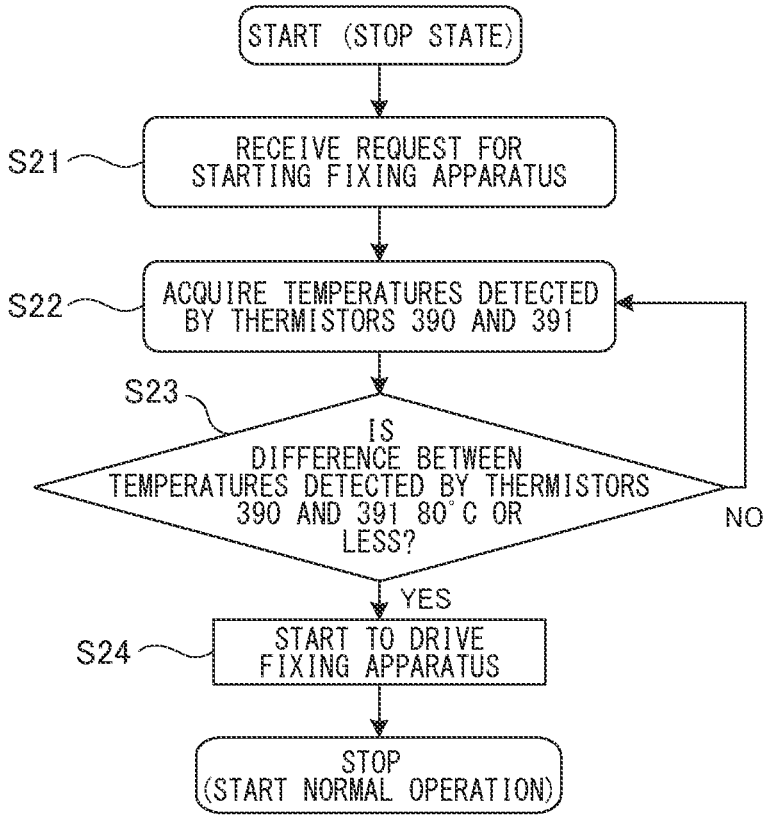
FIG. 13 is a flowchart illustrating control performed when the fixing apparatus of the second embodiment is driven.

FIG. 12 illustrates the temperature of the fixing belt 310 of the present embodiment versus time, obtained after the CPU 32 receives an instruction to stop the rotation of the fixing belt 310 and stops the rotation of the fixing belt 310. The temperature of the heating roller 340 obtained when the fixing belt 310 is stopped is 200° C. The difference between the temperature detected by the thermistor 390 and the temperature detected by the thermistor 391 is calculated by the CPU 32, and if the difference in temperature exceeds a predetermined difference in temperature, the CPU 32 does not start to rotate the fixing belt 310. Specifically, in a period of time from when the fixing belt 310 is stopped until the time before 40 seconds have elapsed since the stop of the fixing belt 310, the fixing belt 310 can be driven without extending the stop time because the difference in temperature does not exceed 80° C. in the period of time. However, in a period of time from when 40 seconds have elapsed until when 60 seconds have elapsed since the stop of the fixing belt 310, the fixing belt 310 is not driven and stopped until the difference in temperature becomes 80° C. or less, because the difference in temperature is equal to or larger than 80° C. in the period of time. When 60 seconds or more have elapsed since the stop of the fixing belt 310, the fixing belt 310 can be driven without extending the stop time because the difference in temperature does not exceed 80° C. in this period of time. With this operation, the stop time can be shorted, and an unnecessary operation for stopping the fixing belt 310 can be eliminated. Consequently, the pre-print time can be shortened.

Hereinafter a flow of control performed when the fixing belt 310 is driven (job is started) will be described with reference to FIG. 13. The CPU 32 receives a request for starting to drive the fixing apparatus 8 that is in a stop state, that is, a request for starting to rotate the fixing belt 310 (S21). Then the CPU 32 obtains the temperature detected by the thermistor 390 and the temperature detected by the thermistor 391 (S22). As described above, receiving a request for starting to drive the fixing apparatus 8 means receiving, by the CPU 32, a signal of a request for starting a print operation, for example.

The CPU 32 determines whether the difference between the temperature detected in S22 by the thermistor 390 and the temperature detected in S22 by the thermistor 391 is equal to or smaller than a predetermined difference in temperature (80° C. in the present embodiment) (S23). If the difference in temperature is larger than the predetermined difference in temperature (80° C.) (S23: NO), then the CPU 32 returns to S22, keeps the stop state of rotation of the fixing belt 310, and obtains the temperature detected by the thermistor 390 and the temperature detected by the thermistor 391 again. In the above-described operations, the CPU 32 may keep the pressing roller 330 away from the fixing belt 310, or may keep the pressing roller 330 in contact with the fixing belt 310. In a case where the CPU 32 brings the pressing roller 330 into contact with the fixing belt 310, the CPU 32 may bring the pressing roller 330 into contact with the fixing belt 310 when the CPU 32 receives the request for starting to drive the fixing apparatus 8.

If the difference between the temperature detected in S22 by the thermistor 390 and the temperature detected in S22 by the thermistor 391 is equal to or smaller than the predetermined difference in temperature (80° C.) (S23: YES), then the CPU 32 starts to drive the fixing apparatus 8, that is, starts to rotate the fixing belt 310 (S24). When the CPU 32 starts to drive the fixing apparatus 8, the CPU 32 sets the speed of the fixing belt 310 at a standby speed, and starts to drive the fixing apparatus 8. In the present embodiment, the standby speed is lower than a print speed (e.g., 300 mm/s), and is 50 mm/s for example. Although the CPU 32 starts to rotate the fixing belt 310 at the standby speed in the present embodiment, the CPU 32 may start to rotate the fixing belt 310 at the print speed. In another case, the rotational speed of the fixing belt 310 may be changed during the rotation of the fixing belt 310. Then the CPU 32 ends the control performed for starting to drive the fixing apparatus 8, and starts the control performed for the normal operation.

As described above, when the CPU 32 receives an instruction to start to rotate the fixing belt 310, the CPU 32 does not start to rotate the fixing belt 310 if the difference between the temperature detected by the thermistor 390 and the temperature detected by the thermistor 391 is larger than a predetermined difference in temperature. In this case, the CPU 32 starts to rotate the fixing belt 310 when the difference between the temperature detected by the thermistor 390 and the temperature detected by the thermistor 391 becomes equal to or smaller than the predetermined difference in temperature. Although the predetermined difference in temperature is 80° C. or less in the above description, the predetermined difference in temperature may be another value. With this operation, the thermal expansion and strain of the fixing belt 310 that are locally produced by a difference in temperature in the rotational direction can be suppressed. As a result, the buckling failure of the fixing belt 310 can be suppressed, and image defects can be prevented from being produced. In addition, since unnecessary rotations of the fixing belt 310 are eliminated, the fixing belt 310 can have a longer life.

In the present embodiment, the temperature of the heating roller 340 is detected by the thermistor 390. However, the thermistor 390 may detect the temperature of the outer circumferential surface of a portion of the fixing belt 310 that is wound around the heating roller 340, and the above-described control may be performed depending on the temperature detected by the thermistor 390. That is, the temperature of the portion of the fixing belt 310 that is wound around the heating roller 340, which serves as a predetermined stretching member, may be the temperature of the heating roller 340 itself, or may be the temperature of the outer circumferential surface of the portion of the fixing belt 310 that is wound around the heating roller 340. The outer circumferential surface of the portion of the fixing belt 310 that is wound around the heating roller 340 is the outer circumferential surface of the portion the fixing belt 310 that is in contact with the heating roller 340, and the outer circumferential surface ranges from its upstream edge to downstream edge in the rotational direction of the fixing belt 310. In this case, the thermistor 390 is disposed in contact with or in the vicinity of the outer circumferential surface of the portion of the fixing belt 310.

In the present embodiment, the fixing member is a belt (a toner image that is still not fixed to a recording material contacts the fixing member). However, the pressing member, which and the fixing member form the nip portion, may be a belt; and the above-described control may be performed in this configuration. In another case, both of the fixing member and the pressing member are belts, and the above-described control may be performed in this configuration.

Third Embodiment

Figure 14:
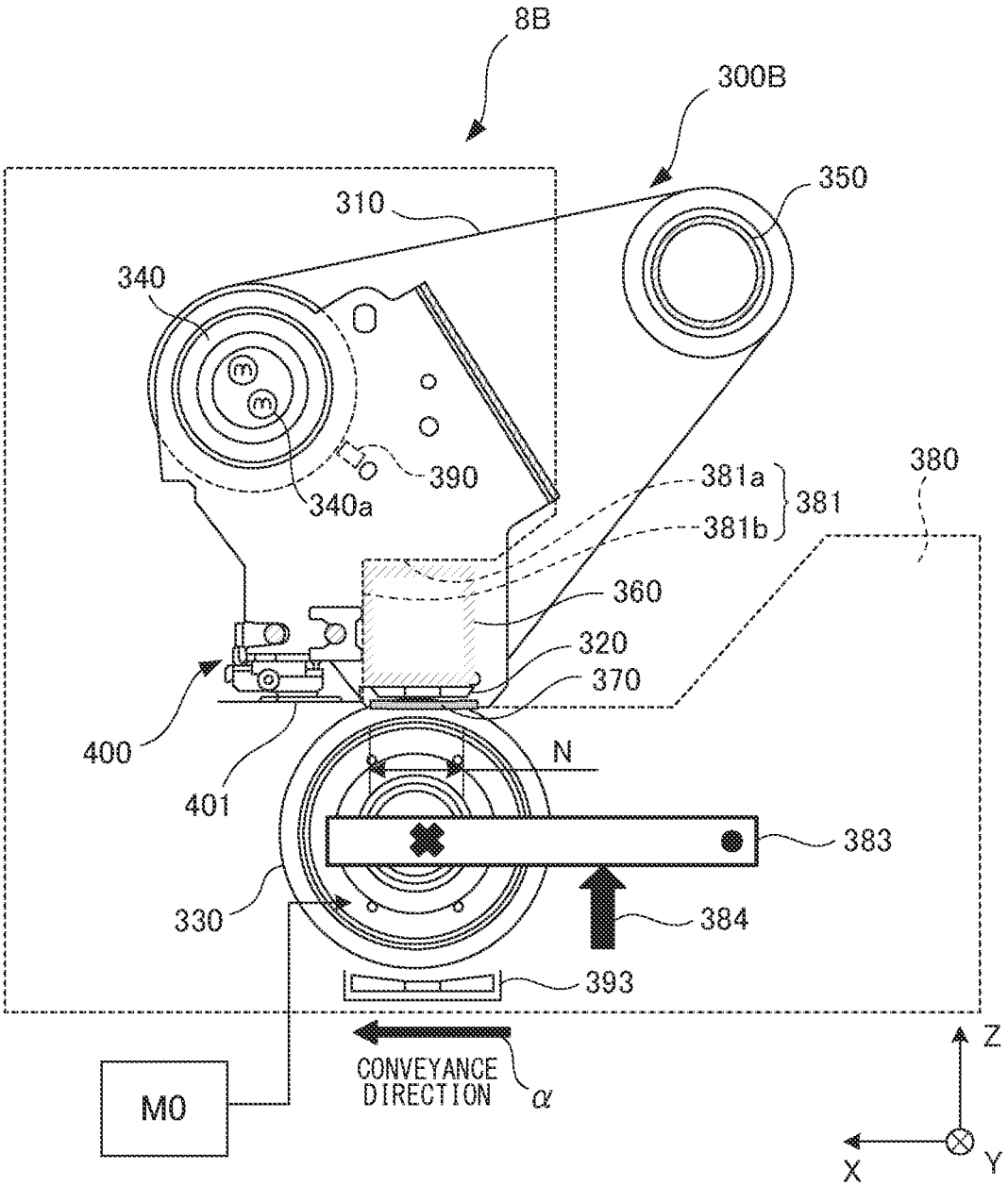
FIG. 14 is a cross-sectional view of a schematic configuration of a fixing apparatus of a third embodiment.
Figure 15:
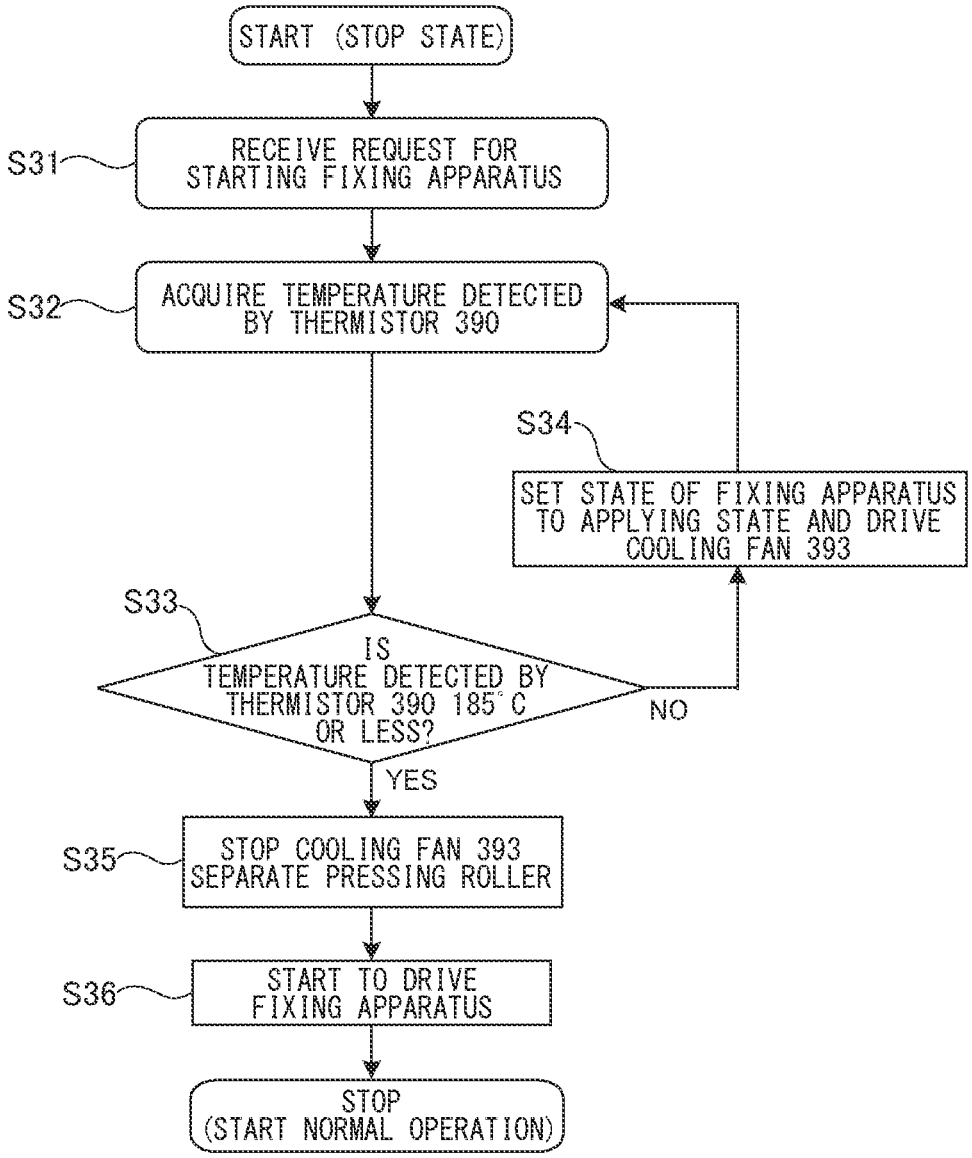
FIG. 15 is a flowchart illustrating control performed when the fixing apparatus of the third embodiment is driven.

Next, a third embodiment will be described with reference to FIGS. 14 and 15. In the present embodiment, in addition to the configuration of the above-described first embodiment, a cooling fan 393 is provided for sending air toward the pressing roller 330. Since the other configuration and operation are the same as those of the above-described first embodiment, a component identical to a component of the first embodiment is given an identical symbol, duplicated description and illustration will be omitted or simplified, and features different from the first embodiment will be mainly described below.

In a fixing apparatus 8B of a heating unit 300B of the present embodiment, the cooling fan 393 is disposed opposite to the nip portion N with respect to the pressing roller 330, for cooling the pressing roller 330. Specifically, as illustrated in FIG. 14, the cooling fan 393 is disposed below the pressing roller 330 in the vertical direction. The cooling fan 393 is operated before or while the fixing belt 310 is driven, for facilitating the decrease in temperature.

That is, if the temperature detected by the thermistor 390 is higher than a predetermined temperature when the CPU 32 (see FIG. 4) receives an instruction to start to rotate the fixing belt 310, the CPU 32 starts to drive the cooling fan 393. If the temperature detected by the thermistor 390 becomes equal to or lower than the predetermined temperature, the CPU 32 stops the cooling fan 393. Thus, in the present embodiment, the cooling fan 393 is operated before the rotation of the fixing belt 310 is started.

Hereinafter, a flow of control performed when the fixing belt 310 is driven will be described with reference to FIG. 15. The CPU 32 receives a request for starting to drive the fixing apparatus 8B, that is, a request for starting to rotate the fixing belt 310 (S31). Then the CPU 32 obtains the temperature detected by the thermistor 390 (S32). As described above, receiving a request for starting to drive the fixing apparatus 8B means receiving, by the CPU 32, a signal of a request for starting a print operation, for example. When the CPU 32 obtains the request for starting to drive the fixing apparatus 8B, the CPU 32 may keep the pressing roller 330 away from the fixing belt 310, or may keep the pressing roller 330 in contact with the fixing belt 310.

The CPU 32 determines whether the temperature obtained in S32 is equal to or lower than a predetermined temperature (185° C. in the present embodiment) (S33). If the temperature detected by the thermistor 390 is higher than the predetermined temperature (185° C.) (S33: NO), then the CPU 32 sets the state of the fixing apparatus 8B to a pressing state, and drives the cooling fan 393 (S34). That is, the CPU 32 brings the pressing roller 330 into contact with the fixing belt 310, and drives the cooling fan 393 without starting the rotation of the fixing belt 310. If the pressing roller 330 has been separated from the fixing belt 310, the CPU 32 brings the pressing roller 330 into contact with the fixing belt 310 in this step. However, the pressing roller 330 may not be brought into contact with the fixing belt 310, and may be kept away from the fixing belt 310. Then the CPU 32 returns to S32, and obtains the temperature detected by the thermistor 390 again.

If the temperature obtained in S32 is equal to or lower than the predetermined temperature (185° C.) (S33: YES), then the CPU 32 stops the cooling fan 393 if the cooling fan 393 is being driven, and separates the pressing roller 330 from the fixing belt 310 (S35). That is, the CPU 32 separates the pressing roller 330 from the fixing belt 310, and stops the cooling fan 393. Then the CPU 32 starts to drive the fixing apparatus 8B, that is, starts to rotate the fixing belt 310 (S36). Then the CPU 32 ends the control performed for starting to drive the fixing apparatus 8B, and starts the control performed for the normal operation. Note that since the pressing roller 330 is brought into contact with the fixing belt 310 under the control performed in the normal operation, the pressing roller 330 may not be separated from the fixing belt 310 in S35.

As described above, if the temperature detected by the thermistor 390 is higher than a predetermined temperature when the CPU 32 receives an instruction to start to rotate the fixing belt 310, the CPU 32 does not start to rotate the fixing belt 310, and drives the cooling fan 393. Although the predetermined temperature is 185° C. or less in the above description, the predetermined temperature may be less than 200° C. That is, the CPU 32 may drive the cooling fan 393 if the temperature detected by the thermistor 390 is equal to or higher than 200° C. when the CPU 32 is to start to rotate the fixing belt 310, and may not drive the cooling fan 393 if the temperature detected by the thermistor 390 is lower than 200° C.

As described above, in the present embodiment, if the temperature detected by the thermistor 390 is higher than a predetermined temperature when the CPU 32 is to start to drive the fixing belt 310, the CPU 32 does not start to rotate the fixing belt 310 and drives the cooling fan 393. In this case, the CPU 32 starts to rotate the fixing belt 310 after the temperature detected by the thermistor 390 becomes equal to or lower than the predetermined temperature. With this operation, the thermal expansion and strain of the fixing belt 310 that are locally produced by a difference in temperature of the fixing belt 310 can be suppressed. As a result, the buckling failure of the fixing belt 310 can be suppressed, and image defects can be prevented from being produced. Furthermore, in the present embodiment, since the cooling fan 393 is driven, the cooling of the fixing belt 310 can be facilitated, and the thermal expansion and strain can be more reliably suppressed from being locally produced in the fixing belt 310.

In the present embodiment, the description has been made for the case where the cooling fan 393 cools the pressing roller 330. However, the cooling fan 393 may cool the fixing belt 310. Furthermore, the cooling fan 393 may cool both of the pressing roller 330 and the fixing belt 310. In short, the cooling fan 393 has only to send air toward at least one of the fixing belt 310 and the pressing roller 330, which serves as a rotary member.

In addition, in the present embodiment, the description has been made as an example for the case where the control in the first embodiment is combined with the control of the cooling fan 393. However, the control in the second embodiment may be combined with the control of the cooling fan 393. In this case, before the CPU 32 receives an instruction to start to rotate the fixing belt 310 and starts to drive the fixing belt 310, the CPU 32 starts to drive the cooling fan 393 if the difference between the temperature detected by the thermistor 390 and the temperature detected by the thermistor 391 (see FIG. 11) is larger than a predetermined difference in temperature. Then the CPU 32 stops the cooling fan 393 when starting to rotate the fixing belt 310.

Fourth Embodiment

Figure 16:
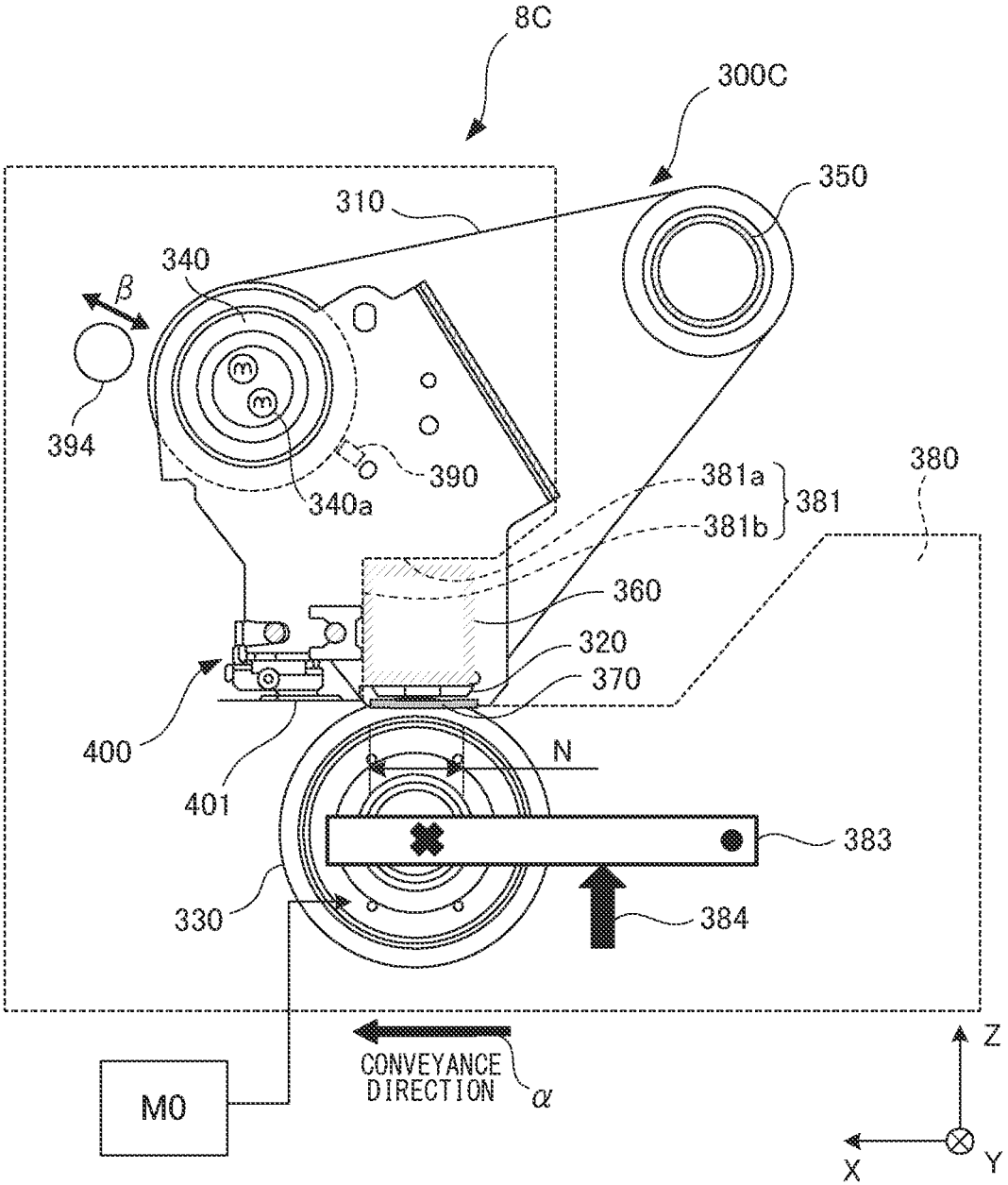
FIG. 16 is a cross-sectional view of a schematic configuration of a fixing apparatus of a fourth embodiment.
Figure 17:
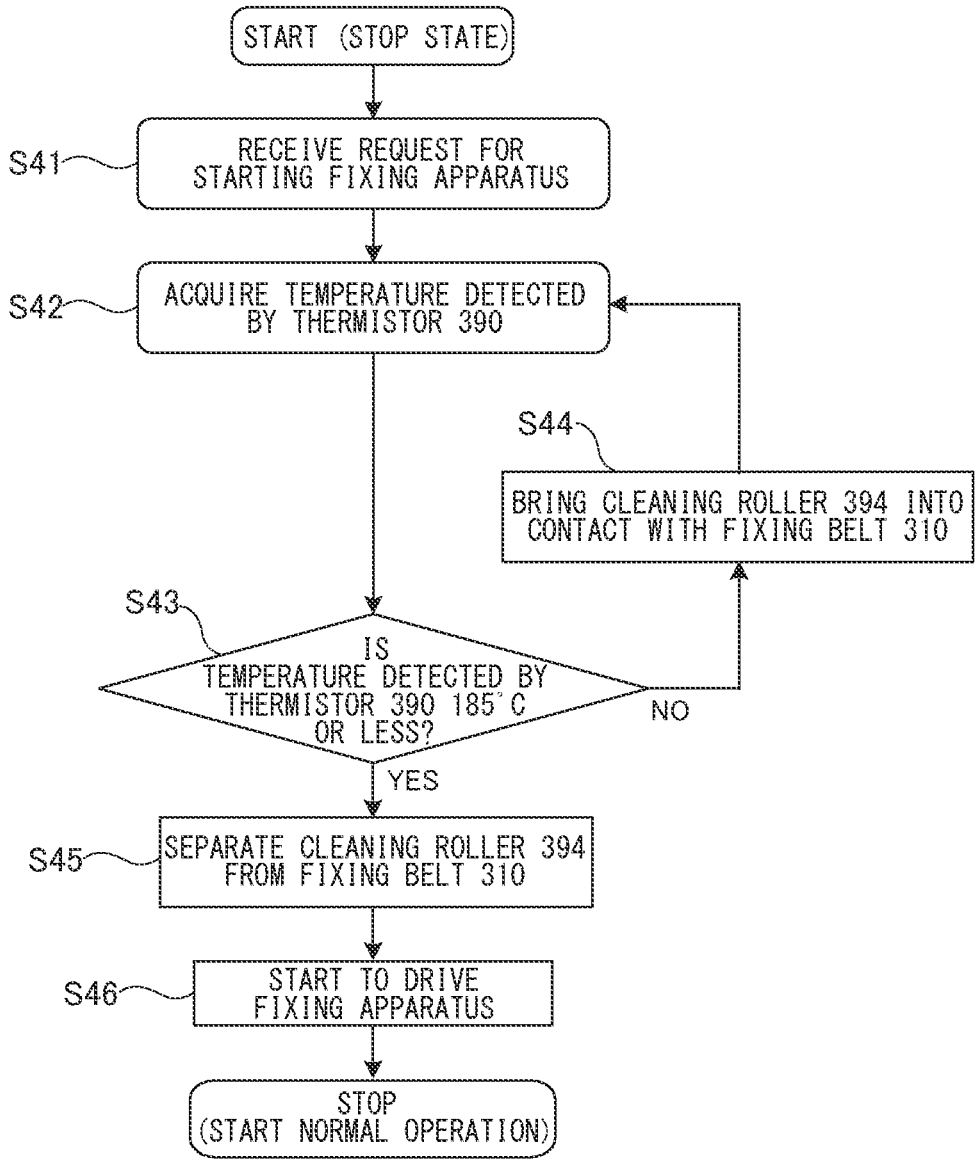
FIG. 17 is a flowchart illustrating control performed when the fixing apparatus of the fourth embodiment is driven.

Next, a fourth embodiment will be described with reference to FIGS. 16 and 17. In the present embodiment, in addition to the configuration of the above-described first embodiment, a cleaning roller 394 is provided for cleaning the outer circumferential surface of the fixing belt 310. Since the other configuration and operation are the same as those of the above-described first embodiment, a component identical to a component of the first embodiment is given an identical symbol, duplicated description and illustration will be omitted or simplified, and features different from the first embodiment will be mainly described below.

In a fixing apparatus 8C of a heating unit 300C of the present embodiment, a cleaning roller 394 is disposed. The cleaning roller 394 serves as a contact-and-separation member, and abuts against or is separated from the outer circumferential surface of a portion of the fixing belt 310 that is wound around the heating roller 340. As illustrated in FIG. 16, the cleaning roller 394 is disposed such that when the cleaning roller 394 abuts against the outer circumferential surface of the portion of the fixing belt 310, the fixing belt 310 is nipped by the cleaning roller 394 and the heating roller 340.

The cleaning roller 394 is forced to abut against or separated from the outer circumferential surface of the fixing belt 310 by a contact-and-separation mechanism (not illustrated), and in the abutment state, the cleaning roller 394 cleans the outer circumferential surface of the fixing belt 310. This is because foreign substances, such as toner and paper dust, may adhere to the fixing belt 310 in the fixing operation. Thus, in the present embodiment, the CPU 32 brings the cleaning roller 394 into contact with the fixing belt 310 regularly or at a predetermined timing, for cleaning the outer circumferential surface of the fixing belt 310. Specifically, the CPU 32 brings the cleaning roller 394 into contact with the fixing belt 310 for cleaning the surface of the fixing belt 310 every time images are formed on a predetermined number of sheets, or when a recording material is jammed in the fixing apparatus 8C.

In addition, in the present embodiment, the cleaning roller 394 is brought into contact with the fixing belt 310 before or while the fixing belt 310 is driven, for facilitating the decrease in temperature. That is, the CPU 32 (see FIG. 4) brings the cleaning roller 394 into contact with the fixing belt 310 if the temperature detected by the thermistor 390 is higher than a predetermined temperature when the CPU 32 receives an instruction to start to rotate the fixing belt 310. If the temperature detected by the thermistor 390 becomes equal to or lower than the predetermined temperature, the CPU 32 separates the cleaning roller 394 from the fixing belt 310. Thus, in the present embodiment, the cleaning roller 394 is brought into contact with the fixing belt 310 before the rotation of the fixing belt 310 is started.

Hereinafter, a flow of control performed when the fixing belt 310 is driven will be described with reference to FIG. 17. The CPU 32 receives a request for starting to drive the fixing apparatus 8C, that is, a request for starting to rotate the fixing belt 310 (S41). Then the CPU 32 obtains the temperature detected by the thermistor 390 (S42). As described above, receiving the request for starting to drive the fixing apparatus 8C means receiving, by the CPU 32, a signal of a request for starting a print operation, for example. When the CPU 32 obtains the request for starting to drive the fixing apparatus 8C, the CPU 32 may keep the pressing roller 330 away from the fixing belt 310, or may keep the pressing roller 330 in contact with the fixing belt 310.

The CPU 32 determines whether the temperature obtained in S42 is equal to or lower than a predetermined temperature (185° C. in the present embodiment) (S43). If the temperature detected by the thermistor 390 is higher than the predetermined temperature (185° C.) (S43: NO), then the CPU 32 brings the cleaning roller 394 into contact with the fixing belt 310 (S44). That is, the CPU 32 brings the cleaning roller 394 into contact with the fixing belt 310, without starting to rotate the fixing belt 310. Then the CPU 32 returns to S42, and obtains the temperature detected by the thermistor 390 again.

If the temperature obtained in S42 is equal to or lower than the predetermined temperature (185° C.) (S43: YES), then the CPU 32 separates the cleaning roller 394 from the belt 310 if the cleaning roller 394 is in contact with the fixing belt 310 (S45). Then the CPU 32 starts to drive the fixing apparatus 8C, that is, starts to rotate the fixing belt 310 (S46).

Thus, if the temperature detected by the thermistor 390 is higher than a predetermined temperature when the CPU 32 receives an instruction to start to rotate the fixing belt 310, the CPU 32 keeps stopping the rotation of the fixing belt 310 and brings the cleaning roller 394 into contact with the fixing belt 310. Although the predetermined temperature is 185° C. or less in the above description, the predetermined temperature may be less than 200° C. That is, the CPU 32 may brine the cleaning roller 394 into contact with the fixing belt 310 if the temperature detected by the thermistor 390 is equal to or higher than 200° C. when the CPU 32 is to start to rotate the fixing belt 310, and may keep the cleaning roller 394 away from the fixing belt 310 if the temperature detected by the thermistor 390 is lower than 200° C.

As described above, in the present embodiment, if the temperature detected by the thermistor 390 is higher than a predetermined temperature when the CPU 32 is to start to drive the fixing belt 310, the CPU 32 keeps stopping the rotation of the fixing belt 310 and brings the cleaning roller 394 into contact with the fixing belt 310. In this case, the CPU 32 starts to rotate the fixing belt 310 after the temperature detected by the thermistor 390 becomes equal to or lower than the predetermined temperature. With this operation, the thermal expansion and strain of the fixing belt 310 that are locally produced by a difference in temperature of the fixing belt 310 can be suppressed. As a result, the buckling failure of the fixing belt 310 can be suppressed, and image defects can be prevented from being produced. Furthermore, in the present embodiment, since the cleaning roller 394 is brought into contact with the fixing belt 310, the cooling of the fixing belt 310 can be facilitated, and the thermal expansion and strain can be more reliably suppressed from being locally produced in the fixing belt 310.

In the present embodiment, the description has been made for the case where the cleaning member that cleans the fixing belt 310 is a cleaning roller. However, the cleaning member that can abut against and be separated from the fixing belt 310 may be a web, which is made of nonwoven fabric for example. In addition, the contact-and-separation member that can abut against and be separated from the fixing belt 310 may not be the cleaning member. For example, the contact-and-separation member may be a grinding member that grinds the surface of the fixing belt 310, or may be a heat-distribution uniforming member that uniforms the heat distribution of the fixing belt 310 in the longitudinal direction. In another case, the contact-and-separation member may be a lubricant supplying member that abuts against the inner circumferential surface of the fixing belt 310 and supplies lubricant to the fixing belt 310.

In the present embodiment, the description has been made as an example for the case where the control in the first embodiment is combined with the control of the contact-and-separation member. However, the control in the second embodiment is combined with the control of the contact-and-separation member. In this case, before the CPU 32 receives an instruction to stag to rotate the fixing belt 310 and starts to drive the fixing belt 310, the CPU 32 brings the contact-and-separation member into contact with the fixing belt 310 if the difference between the temperature detected by the thermistor 390 and the temperature detected by the thermistor 391 (see FIG. 11) is larger than a predetermined difference in temperature. Then the CPU 32 separates the contact-and-separation member from the fixing belt 310 before starting to rotate the fixing belt 310.

Other Embodiments

The above-described third and fourth embodiments may be combined with another embodiment. For example, in a case where the first embodiment is combined with the third and fourth embodiments, the CPU 32 drives the cooling fan 393 and brings the contact-and-separation member into contact with the fixing belt 310 before starting to drive the fixing belt 310 in the first embodiment. In a case where the second embodiment is combined with the third and fourth embodiments, the CPU 32 drives the cooling fan 393 and brings the contact-and-separation member into contact with the fixing belt 310 before starting to drive the fixing belt 310 in the second embodiment.

In the above-described embodiments, the description has been made for the fixing apparatus in which the fixing belt is stretched by and wound around the fixing pad, the assistance driving roller, and the steering roller. However, the fixing apparatus for which the present invention can be applied is not limited to this. For example, the fixing apparatus may be an apparatus in which the fixing belt is stretched by and wound around a single stretching roller and a fixing pad. In short, the fixing apparatus has only to include the fixing pad and at least one stretching roller, which stretch the fixing belt.

In addition, in the above-described embodiments, if the temperature of the heating roller is higher than a predetermined temperature, the rotation of the fixing belt is stopped until the temperature of the heating roller becomes equal to or lower than the predetermined temperature. However, there is a case in which it takes much time for the temperature of the heating roller to have become equal to or lower than the predetermined temperature since the receipt of a rotation start signal. For such a case, the CPU 32 may stop the rotation of the fixing belt for a predetermined period of time if the CPU 32 receives the rotation start signal, and it may start to rotate the fixing belt after the predetermined period of time has elapsed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-093913, filed May 29, 2020 which is hereby incorporated by reference herein in its entirety.

What is claimed is:

1. An image forming apparatus comprising:

an endless rotatable belt;

a rotary pressing member configured to form a nip portion between the rotary pressing member and the belt, the nip portion being a portion in which a toner image borne by a recording material is fixed to the recording material while the recording material is nipped and conveyed;

a pressing member configured to stretch the belt and press the rotary pressing member via the belt;

a driving unit configured to rotate the belt;

a heating roller comprising a heater and configured to stretch and heat the belt;

a temperature detection member configured to detect a temperature of the heating roller; and a control unit configured to control the driving unit such that the driving unit does not start to rotate the belt during a period of time for a preparatory operation if the temperature of the heating roller is higher than a predetermined temperature, wherein the preparatory operation is an operation performed for enabling image formation after an error or a jam is handled.

2. The image forming apparatus according to claim 1, wherein the control unit is configured to control the driving unit such that the driving unit starts to rotate the belt in response to the temperature of the heating roller, which was higher than the predetermined temperature, dropping to a rotation start temperature that is set equal to or lower than the predetermined temperature.

3. The image forming apparatus according to claim 2, wherein the predetermined temperature is equal to the rotation start temperature.

4. The image forming apparatus according to claim 2, wherein the control unit is configured to form an image in response to the temperature of the heating roller rising to an image formation temperature that is set higher than the rotation start temperature, after the driving unit starts to rotate the belt.

5. The image forming apparatus according to claim 2, wherein the control unit is configured to abut the rotary pressing member against the belt in a case where the temperature of the heating roller is higher than the predetermined temperature.

6. The image forming apparatus according to claim 5, wherein the control unit is configured to separate the rotary pressing member from the belt in response to the temperature of the heating roller dropping to the rotation start temperature.

7. The image forming apparatus according to claim 1, wherein the belt comprises a base layer whose material is resin.

8. The image forming apparatus according to claim 1, further comprising a fan configured to send air toward at least one of the belt and the rotary pressing member, wherein the control unit is configured to start to operate the fan in a case where the temperature of the heating roller is higher than the predetermined temperature.

9. An image forming apparatus comprising:

an endless rotatable belt;

a rotary pressing member configured to form a nip portion between the rotary pressing member and the belt, the nip portion being a portion in which a toner image borne by a recording material is fixed to the recording material while the recording material is nipped and conveyed;

a pressing member configured to stretch the belt and press the rotary pressing member via the belt;

a driving unit configured to rotate the belt;

a heating roller comprising a heater and configured to stretch and heat the belt;

a temperature detection member configured to detect a temperature of the heating roller; and a control unit configured to control the driving unit such that the driving unit waits to rotate the belt during a period of time for a preparatory operation if the temperature of the heating roller is higher than a predetermined temperature when the control unit receives a signal to start to rotate the belt, wherein the preparatory operation is an operation performed for enabling image formation after an error or a jam is handled.

10. The image forming apparatus according to claim 9, wherein the control unit is configured to control the driving unit such that the driving unit starts to rotate the belt if the temperature of the heating roller is lower than the predetermined temperature when the control unit receives the signal.

11. The image forming apparatus according to claim 9, wherein the control unit is configured to control the driving unit such that the driving unit starts to rotate the belt in response to the temperature of the heating roller, which was higher than the predetermined temperature when the control unit receives the signal, dropping to a rotation start temperature that is set equal to or lower than the predetermined temperature.

12. The image forming apparatus according to claim 11, wherein the predetermined temperature is equal to the rotation start temperature.

13. The image forming apparatus according to claim 11, wherein the control unit is configured to form an image in response to the temperature of the heating roller rising to an image formation temperature that is set higher than the rotation start temperature, after the driving unit starts to rotate the belt.

14. The image forming apparatus according to claim 11, wherein the control unit is configured to abut the rotary pressing member against the belt in a case where the temperature of the heating roller is higher than the predetermined temperature when the control unit receives the signal.

15. The image forming apparatus according to claim 14, wherein the control unit is configured to separate the rotary pressing member from the belt in response to the temperature of the heating roller dropping to the rotation start temperature.

16. The image forming apparatus according to claim 9, wherein the belt comprises a base layer whose material is resin.

17. The image forming apparatus according to claim 9, further comprising a fan configured to send air toward at least one of the belt and the rotary pressing member, wherein the control unit is configured to start to operate the fan in a case where the temperature of the heating roller is higher than the predetermined temperature when the preparatory operation is started, or when a predetermined period of time has elapsed since a start of the preparatory operation.

18. The image forming apparatus according to claim 9, wherein the control unit is configured to control the driving unit such that the driving unit starts to rotate the belt after a predetermined period of time has elapsed since the control unit started to wait to rotate the belt.

19. An image forming apparatus comprising:

an endless rotatable belt;

a rotary pressing member configured to form a nip portion between the rotary pressing member and the belt, the nip portion being a portion in which a toner image borne by a recording material is fixed to the recording material while the recording material is nipped and conveyed;

a pressing member configured to stretch the belt and press the rotary pressing member via the belt;

a driving unit configured to rotate the belt;

a heating roller comprising a heater and configured to stretch and heat the belt;

a first temperature-detection member configured to detect a temperature of the heating roller;

a second temperature-detection member configured to detect a temperature of the belt; and a control unit configured to control the driving unit such that the driving unit does not start to rotate the belt during a period of time for a preparatory operation if a temperature difference between the temperature detected by the first temperature-detection member and the temperature detected by the second temperature-detection member is larger than a predetermined temperature difference, wherein the preparatory operation is an operation performed for enabling image formation after an error or a jam is handled.

* * * * *